US007600496B2

(12) United States Patent
Nakamura et al.

(10) Patent No.: US 7,600,496 B2
(45) Date of Patent: Oct. 13, 2009

(54) VALVE OPERATING APPARATUS FOR INTERNAL COMBUSTION ENGINE

(75) Inventors: Makoto Nakamura, Kanagawa (JP); Mikihiro Kajiura, Tokyo (JP); Yoshihiko Yamada, Kanagawa (JP); Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 198 days.

(21) Appl. No.: 11/700,819

(22) Filed: Feb. 1, 2007

(65) Prior Publication Data

US 2007/0175424 A1 Aug. 2, 2007

(30) Foreign Application Priority Data

Feb. 2, 2006 (JP) ..... 2006-025252

(51) Int. Cl.
*F01L 1/34* (2006.01)

(52) U.S. Cl. ..... 123/90.16; 123/90.39; 123/90.44; 74/569

(58) Field of Classification Search ..... 123/90.15, 123/90.16, 90.17, 90.18, 90.2, 90.27, 90.31, 123/90.39, 90.44, 90.6; 74/559, 567, 569
See application file for complete search history.

(56) References Cited

U.S. PATENT DOCUMENTS 5,996,540 A 12/1999 Hara
6,705,264 B2 * 3/2004 Onoue ..... 123/90.39
7,246,578 B2 * 7/2007 Nakamura et al. ..... 123/90.16

FOREIGN PATENT DOCUMENTS

| | | |
|---|---|---|
| CN | 1657746 | 8/2005 |
| JP | 10-280931 A | 10/1998 |
| JP | 2003-176707 A | 6/2003 |

* cited by examiner

*Primary Examiner*—Ching Chang
(74) *Attorney, Agent, or Firm*—Antonelli, Terry, Stout & Kraus, LLP.

(57) ABSTRACT

A valve operating apparatus for an internal combustion engine including a drive cam, first and second swing cams, first and second motion transmission mechanisms and first and second valve actuating members. The first and second swing cams are provided with identical swing motion characteristic with respect to a rotation angle of the drive cam through the first and second motion transmission mechanisms. The first swing cam and the first valve actuating member cooperate with each other to provide a valve lift amount of the engine valve for the first group of cylinders with respect to a swing angle of the first swing cam which is identical to a valve lift amount of the engine valve for the second group of cylinders with respect to a swing angle of the second swing cam.

13 Claims, 16 Drawing Sheets

K1
X1
X2
X3
X4
X
J
Z
θ1
θ2
θ3
θ4
L1i
L1p
S'3
β'3

K1
K2
η
X
X5
X6
X7
X8
Y6
Y8
Z
(θ1)
θ5
θ6
θ7
θ8
L2i
L2p
1
2
3
4
5
6
9
10
11
12
20
21
22
23
24
25
26
27

K1
X1
X2
X3
X4
X
P3
S3
B
B3
Z
θ1
θ2
θ3
θ4
L1i
L1p

X5
X6
X7
X8
K1
K2
L2i
L2p
θ5
θ6
θ7
θ8
(θ1)

S1
S2
S3
S4
K1
X1
X2
X3
X4
L1i
L1p
θ1
θ2
θ3
θ4
β1
β2
β3
β4
118
118b

S5
S6
S7
S8
L2i
L2p
K1
K2
X5
X6
X7
X8
θ5
θ6
θ7
θ8
β5
β6
β7
β8
(θ1)
η

VALVE OPERATING APPARATUS FOR INTERNAL COMBUSTION ENGINE

BACKGROUND OF THE INVENTION

The present invention relates to a valve operating apparatus for an internal combustion engine with a plurality of cylinder groups which variably controls the valve lift and open duration of engine valves depending on engine operating conditions, and particularly to the valve operating apparatus which can reduce a difference between valve lift characteristics of the engine valves of the respective cylinder groups.

Japanese Patent Application First Publication No. 2003-176707 discloses a valve operating apparatus for a V-type internal combustion engine having two groups of cylinders. The valve operating apparatus of this conventional art includes intake valves which are slidably disposed within cylinders in cylinder heads of right and left banks, two drive shafts which are supported on the respective cylinder heads and have drive cams integrally formed with the drive shafts on the outer circumferential periphery, swing cams swingably supported on the respective drive shafts, valve lifters which are contacted with the swing cams and actuate the respective intake valves, and a variable operation mechanism for variably controlling the valve lift and open duration of the respective intake valves. The drive shafts on the right and left banks are operated to rotate in the same direction by torque from a crankshaft of the engine.

The variable operation mechanism of the valve operating apparatus of the above conventional art includes a multi-link motion transmission mechanism for converting the torque of the drive cams to a swing motion of the swing cams and a control mechanism which controls the motion transmission mechanism depending on the engine operating condition so as to vary contact portions of the cam surfaces of the swing cams which are contacted with the corresponding valve lifters to thereby adjust the valve lift amount and open duration of the respective intake valves. A variable phase control mechanism is provided for controlling an offset in valve lift phase between the right bank side and the left bank side.

SUMMARY OF THE INVENTION

In the valve operating apparatus of the above conventional art, the intake valves, the valve lifters and the camshafts on the right and left banks are arranged to be mirror-symmetric with respect to a bank center line between the right and left banks in order to avoid large modification in construction of the conventional cylinder head. Similarly, the variable operation mechanism is arranged to be mirror-symmetric with respect to the bank center line.

In the valve operating apparatus of the above conventional art, the offset in valve lift phase between the right bank side and the left bank side is compensated by the phase variably controlling mechanism so that the start point and the end point of the valve lift on the right bank side are aligned with those on the left bank side. However, as shown in FIG. 16, valve lift curves "a" and "b" of the intake valves on the right and left banks have a reversed relation to each other in which a peak lift in the valve lift curve "a" is located on the advanced side and a peak lift in the valve lift curve "b" is located on the retarded side, while the peak lifts are equal to each other.

Specifically, in the valve operating apparatus of the above conventional art which includes the variable operation mechanism equipped with the multi-link motion transmission mechanism, the valve lift curve "a" includes an up-lift portion a' and a down-lift portion a" as shown in FIG. 16. The up-lift portion a' is disposed within an up-ramp period from the moment immediately after, an up-lift motion of the intake valves has been started by operating the swing cams by the motion transmission mechanism as the drive cams are rotated, to the moment the intake valves have reached the peak lift. The up-lift portion a' is steeply upwardly inclined. In contrast, the down-lift portion a" is disposed within a down-ramp period from the moment the intake valves have reached the peak lift to the moment immediately before a down-lift motion of the intake valves has been ended. The down-lift portion a" is slowly downwardly inclined. As a result, the valve lift curve "a" becomes asymmetric with respect to a normal to the valve lift curve "a" which extends through the peak lift point. This is because the motion transmission mechanism has different attitudes upon causing the up-lift motion and the down-lift motion of the intake valves. Therefore, such an asymmetric valve lift curve will inevitably occur in the variable operation mechanism including the multi-link motion transmission mechanism.

Accordingly, in the valve operating apparatus of the above conventional art in which the intake valves and the variable operation mechanisms on the respective sides of the right and left banks of the V-type internal combustion engine are symmetrically arranged with respect to the bank center line, there will occur non-alignment in the valve lift curves "a" and "b" of the intake valves on the right and left banks as shown in FIG. 16. This causes a difference in the drive shaft angle between the right bank side and the left bank side upon the peak valve lift, namely, a difference in the position and speed of pistons between one cylinder group within the right bank and the other cylinder group within the left bank, at the moment of the peak lift, so that there occurs a difference in quantity of intake air which is introduced to the combustion chambers between the one cylinder group within the right bank and the other cylinder group within the left bank. Therefore, combustion characteristics in the respective combustion chambers of the one cylinder group and the other cylinder group become different from each other so that fluctuation in engine torque will occur.

It is an object of the present invention to solve the above-described problems encountered in the conventional art and to provide a valve operating apparatus for an internal combustion engine, which is capable of providing the same valve lift curve of engine valves between two groups of cylinders to thereby provide the same combustion characteristic between the two groups of cylinders and ensure stability of the engine operation.

In one aspect of the present invention, there is provided a valve operating apparatus for an internal combustion engine that includes a first group of cylinders and a second group of cylinders and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam;

the drive cam, the swing cam, the motion transmission mechanism and the valve actuating member being disposed for each of the cylinders in the first and second groups, wherein the swing cam includes a first swing cam for the first group of cylinders and a second swing cam for the second group of cylinders, the motion transmission mechanism includes the first motion transmission mechanism for the first group of cylinders and a second motion transmission mechanism for the second group of cylinders, and the valve actuating member includes a first valve actuating member for the first group of cylinders and a second valve actuating member for the second group of cylinders, wherein the first and second swing cams are provided with identical swing motion characteristic with respect to a rotation angle of the drive cam through the first and second motion transmission mechanisms, and wherein the first swing cam and the first valve actuating member cooperate with each other to provide a valve lift amount of the engine valve for the first group of cylinders with respect to a swing angle of the first swing cam which is identical to a valve lift amount of the engine valve for the second group of cylinders with respect to a swing angle of the second swing cam.

In a further aspect of the present invention, there is provided a valve operating apparatus for a V-type internal combustion engine that includes a first group of cylinders and a second group of cylinders which are arranged in a generally V-shape and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam, the valve actuating member including a cam follower which follows the swing cam;

the drive cam, the swing cam, the motion transmission mechanism and the valve actuating member being disposed for each of the cylinders in the first and second groups, wherein the swing cam includes a first swing cam for the first group of cylinders and a second swing cam for the second group of cylinders, and the motion transmission mechanism includes a first motion transmission mechanism for the first group of cylinders and a second motion transmission mechanism for the second group of cylinders, wherein the first and second swing cams are provided with identical swing motion characteristic through the first and second motion transmission mechanisms, and wherein the first swing cam has a cam profile configured to provide a valve lift curve of the engine valve for the first group of cylinders which is identical to a valve lift curve of the engine valve for the second group of cylinders, the cam profile of the first swing cam being set as an envelope which is drawn by arcuate loci of the cam follower following the first swing cam when the engine valve for the first group of cylinders is operated to be open and closed, the envelope being determined on the basis of a distance between a center of curvature of each of the loci of the cam follower and the axis of the first swing cam, and an angle which is formed between a line extending through the center of curvature of each of the loci of the cam follower and the axis of the first swing cam and a line extending through the axis of the first swing cam and a connection point between the first swing cam and the first motion transmission mechanism.

In a still further aspect of the present invention, there is provided a valve operating apparatus for an internal combustion engine that includes a first group of cylinders and a second group of cylinders and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam, the valve actuating member including a cam follower which follows the swing cam;

the drive cam, the swing cam, the motion transmission mechanism and the valve actuating member being disposed for each of the cylinders in the first and second groups, wherein the swing cam includes a first swing cam for the first group of cylinders and a second swing cam for the second group of cylinders, and the motion transmission mechanism includes a first motion transmission mechanism for the first group of cylinders and a second motion transmission mechanism for the second group of cylinders, wherein the first and second motion transmission mechanisms are constructed to provide the first and second swing cams with identical swing motion characteristic, and wherein the first swing cam has a cam profile which is different from a cam profile of the second swing cam, the cam profile of the first swing cam being set as an envelope which is drawn by arcuate loci of the cam follower of the valve actuating member which follows the first swing cam when the first swing cam is operated so as to provide a valve lift curve of the engine valve for the first group of cylinders which is identical to a valve lift curve of the engine valve for the second group of cylinders.

The other objects and features of the present invention will become understood from the following description with reference to the accompanying drawings.

DETAILED DESCRIPTION OF THE INVENTION

Figure 1:
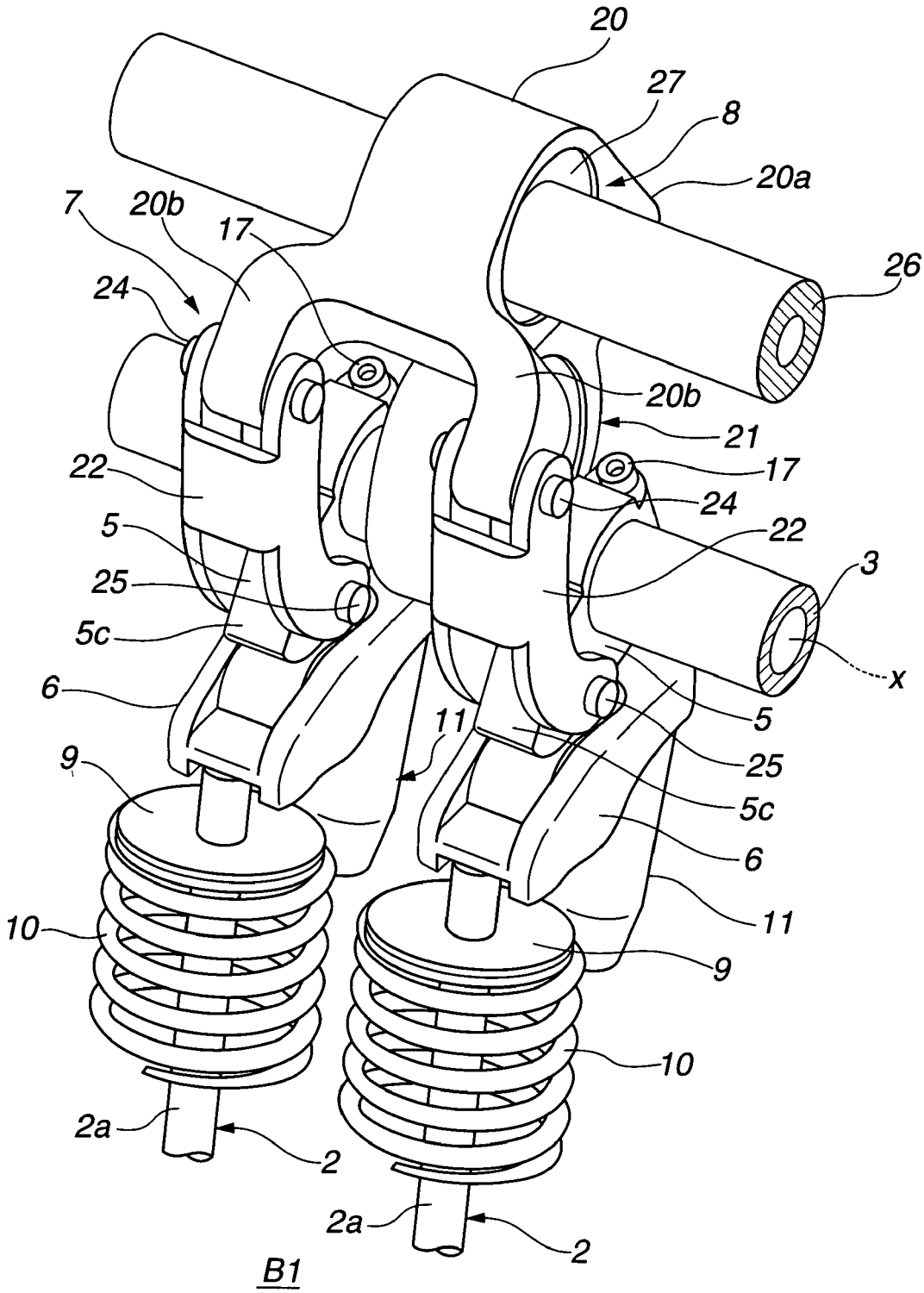
FIG. 1 is a perspective view of a first embodiment of a valve operating apparatus for an internal combustion engine, according to the present invention, as viewed from a front side thereof.

In the following, embodiments of the present invention will be explained in detail with reference to the accompanying drawings. For ease of understanding, various directional terms, such as, right, left, upper, lower, rightward and the like are used in the following description. However, such terms are to be understood with respect to only the drawing on which the corresponding part or portion is shown.

Figure 4:
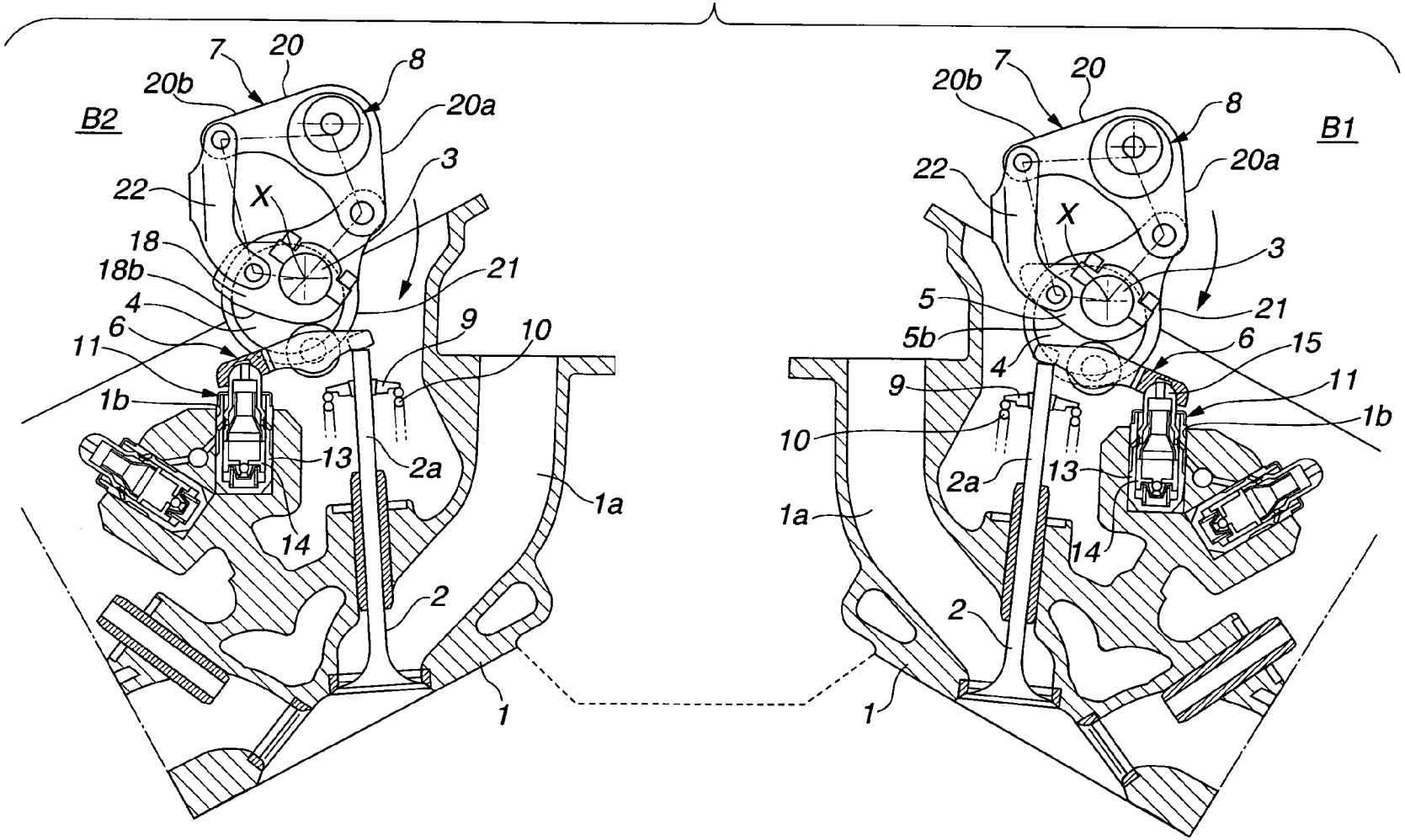
FIG. 4 is a cross section of an essential part of a V-type internal combustion engine to which the first embodiment of the valve operating apparatus is applied.

Referring to FIGS. 1 and 4, there is shown a valve operating apparatus of a first embodiment of the present invention. The valve operating apparatus of the first embodiment is constructed to be applicable to a V6 (V-type six-cylinder) internal combustion engine including two groups each having three cylinders which are disposed within right bank B1 and left bank B2, respectively. Right bank B1 and left bank B2 are mirror-symmetrically arranged at a predetermined angle of inclination with respect to a bank centerline between right and left banks B1 and B2. Each of the two groups of cylinders are constituted of three cylinders, each cylinder having two intake valves 2, 2, viz. engine valves. Intake valves 2, 2 are operative to open and close two intake ports 1*a*, 1*a* which are formed in each of cylinders of cylinder heads 1, 1 of right and left banks B1 and B2. An intake system is disposed on an intermediate portion of the V6 engine between right and left banks B1 and B2.

As shown in FIG. 4, the valve operating apparatus of the first embodiment includes two hollow drive shafts 3, 3 which are disposed on right bank B1 and left bank B2, respectively. Each of drive shafts 3, 3 extends in a longitudinal direction of the engine and is rotated in synchronization with a crankshaft of the engine. In this embodiment, drive shaft 3 is a camshaft with two drive cams 4, 4. Each of drive cams 4, 4 is fixed to drive shaft 3 and located in a position corresponding to each of the cylinders. A pair of swing arms 6, 6 are disposed on right bank B1 and left bank B2, respectively, and serve as valve actuating members which actuate intake valves 2, 2 through pivots 11, 11. A pair of swing cams 5, 5 are disposed on drive shaft 3 on a side of right bank B1 so as to be swingable about an axis. A pair of swing cams 18, 18 are disposed on drive shaft 3 on a side of left bank B2 so as to be swingable about an axis. Motion transmission mechanisms 7, 7 are provided on right and left banks B1 and B2, respectively. Each of motion transmission mechanisms 7, 7 is disposed between drive cam 4 and swing cams 5, 5 or 18, 18 and connects drive cam 4 and swing cams 5, 5 or 18, 18 with each other. Motion transmission mechanism 7 acts to convert torque of drive cam 4 to a swing motion of respective swing cams 5 and 18. Control mechanisms 8, 8 are provided on right and left banks B1 and B2, respectively, and act to operate respective motion transmission mechanisms 7, 7 to control a valve lift amount and an operating angle of intake valves 2, 2. Swing arms 6, 6 and pivots 11, 11 constitute a valve actuating mechanism. Swing cams 5, 18, motion transmission mechanism 7 and control mechanism 8 constitute a variable operation mechanism.

As shown in FIG. 4, the valve actuating mechanisms on the sides of right bank B1 and left bank B2 are arranged to be mirror-symmetric with respect to the bank centerline of right and left banks B1 and B2. That is, the valve actuating mechanism on the side of right bank B1 and the valve actuating mechanism on the side of left bank B2 are disposed on both sides of the intake system so as to be symmetric with respect to the intake system. In contrast, the variable operation mechanisms on the respective sides of right and left banks B1 and B2 are arranged in a parallel relation to each other with respect to the bank centerline, namely, oriented in a same direction.

For ease of understanding, referring to FIGS. 1-3, the valve operating apparatus of the first embodiment on the side of right bank B1 will be explained hereinafter. However, swing cam 5 on the side of right bank B1 and swing cam 18 on the side of left bank B2 which have cam profiles different from each other, will be explained, respectively.

Figure 2:
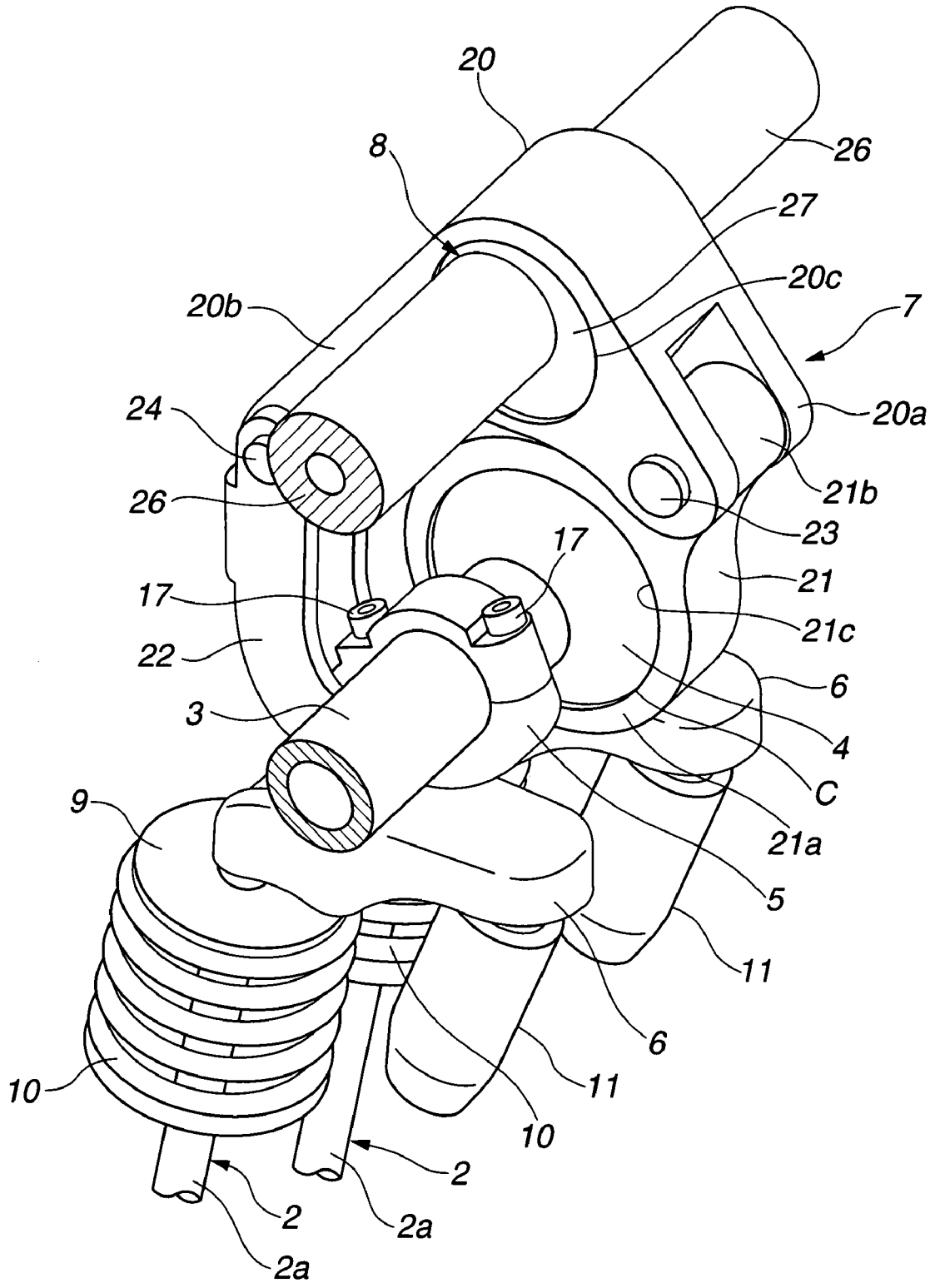
FIG. 2 is a perspective view of the first embodiment of the valve operating apparatus, as viewed from another direction.
Figure 3:
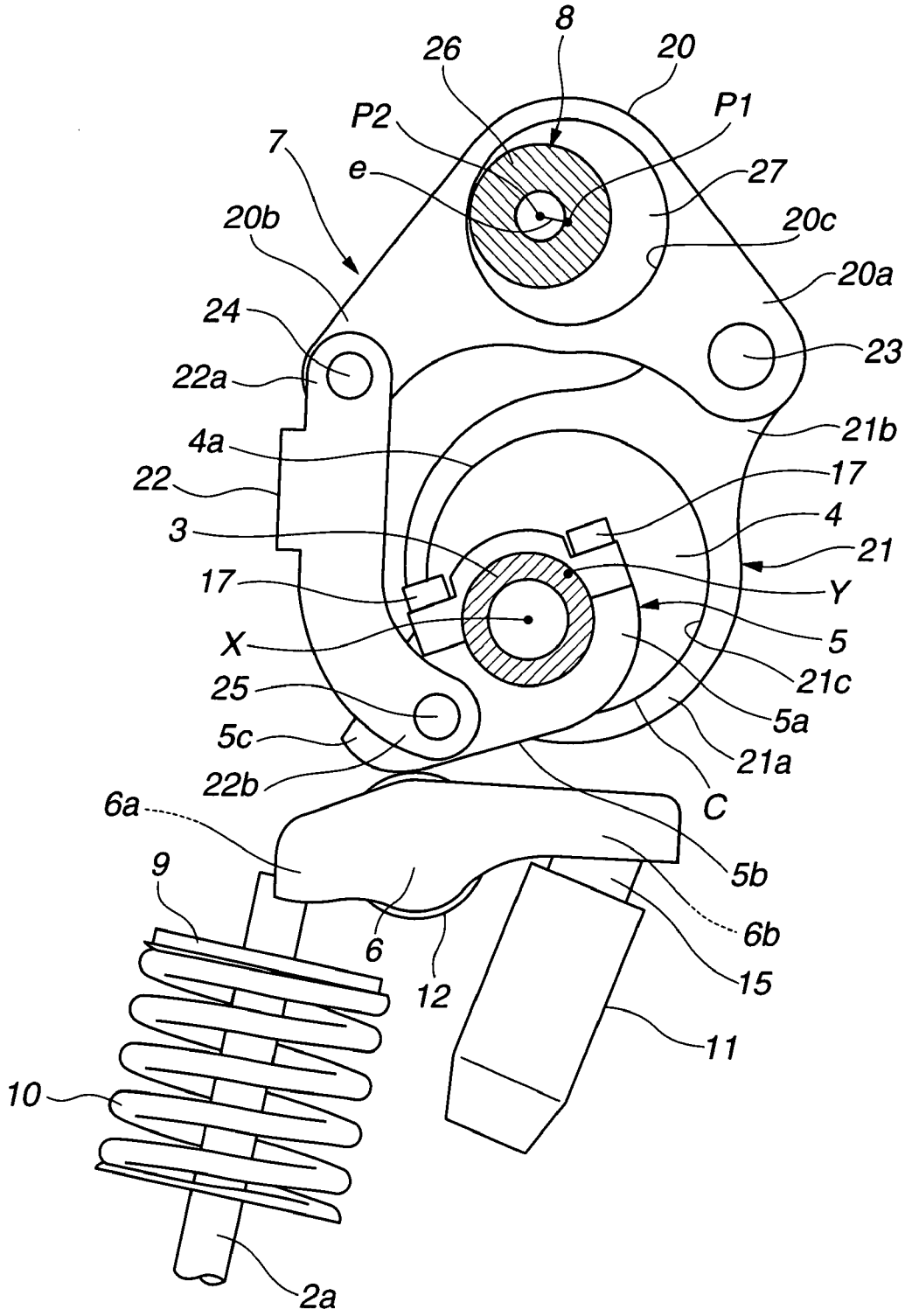
FIG. 3 is a cross section of the first embodiment of the valve operating apparatus, taken along a plane perpendicular to a longitudinal direction of the engine.

As shown in FIGS. 1-3, each of intake valves 2, 2 includes valve stem 2*a* having an upper end portion to which disk-shaped spring retainer 9 is fixed through a cotter. Coiled valve spring 10 is compressed between spring retainer 9 and a bottom of a circular bore, not shown, which is formed in cylinder head 1. Intake valve 2 is biased by valve spring 10 in a direction toward a closed position. In other words, when valve stem 2*a* is pressed down against the biasing force of valve spring 10, the corresponding intake valve 2 is forced to take its open position.

Drive shaft 3 is disposed above intake valves 2, 2 and extends in the longitudinal direction of the engine. Drive shaft 3 is rotatably supported by a plurality of bearings (not shown) which are mounted on an upper portion of cylinder head 1. Drive shaft 3 is connected with the crankshaft of the engine through a driven sprocket connected to one end portion of drive shaft 3 and a timing chain wound around the driven sprocket. Under operation of the engine, torque from the crankshaft is transmitted to drive shafts 3, 3 on the sides of right and left banks B1 and B2 through the driven sprocket and the timing chain to thereby rotate drive shafts 3, 3 about central axes X, X in a same direction.

Drive cam 4 is integrally formed with drive shaft 3 and rotates about central axis X of drive shaft 3 together with drive shaft 3. In this embodiment, there is provided one drive cam 4 per cylinder. As shown in FIG. 3, drive cam 4 is formed into a generally disk-shape and has central axis Y which is located offset from central axis X of drive shaft 3. Outer circumferential surface 4*a* of drive cam 4, therefore, has an eccentric cam profile.

Swing cams 5, 5 are swingably supported on drive shaft 3 on the side of right bank B1 and located on both sides of drive cam 4 symmetrically with respect to drive cam 4. Swing cams 5, 5 are operative to open and close intake valves 2, 2 through swing arms 6, 6. As shown in FIG. 3, swing cams 5, 5 are identical in shape to each other, and each have a generally raindrop-shape in cross section. Each of swing cams 5, 5 includes larger base portion 5*a* that is supported on drive shaft 3 so as to be swingable about the axis as a swing axis. In this embodiment, the axis of swing cam 5 is aligned with central axis X of drive shaft 3. Swing cam 5 further includes cam surface 5*b* on a lower side thereof which has a semicircular section and extends from larger base portion 5*a* toward cam nose portion 5*c*. When larger base portion 5*a* is contacted with roller 12 which is supported by swing arm 6, the corresponding intake valve 2 contacted with the one end of swing arm 6 has a minimum lift amount. On the other hand, when cam nose portion 5*c* is contacted with roller 12, the corresponding intake valve 2 has a maximum lift amount.

Base portion 5*a* of swing cam 5 is formed by upper and lower split portions which are coupled to each other by two bolts 17, 17 in such a manner as to be mounted onto drive shaft 3. The upper and lower split portions of base portion 5*a* each have semicircular inner surfaces which come into sliding contact with an outer circumferential surface of drive shaft 3.

Swing cams 18, 18 are swingably supported by drive shaft 3 on the side of left bank B2 and located on both sides of drive cam 4 symmetrically with respect to drive cam 4. Swing cams 18, 18 are operative to open and close intake valves 2 and 2 through swing arms 6, 6. Similar to swing cams 5, 5 on the side of right bank B1, each of swing cams 18, 18 includes larger base portion 18*a* that is supported on drive shaft 3 so as to be swingable about the axis as a swing axis. In this embodiment, the axis of swing cam 18 is aligned with central axis X of drive shaft 3. Swing cam 18 further includes cam surface 18*b* on a lower side thereof which has a semicircular section. Cam surface 18*b* of swing cam 18 has a cam profile as shown in FIG. 5B which is different from the cam profile of cam surface 5*b* of swing cam 5 as shown in FIG. 5A.

Figure 5B:
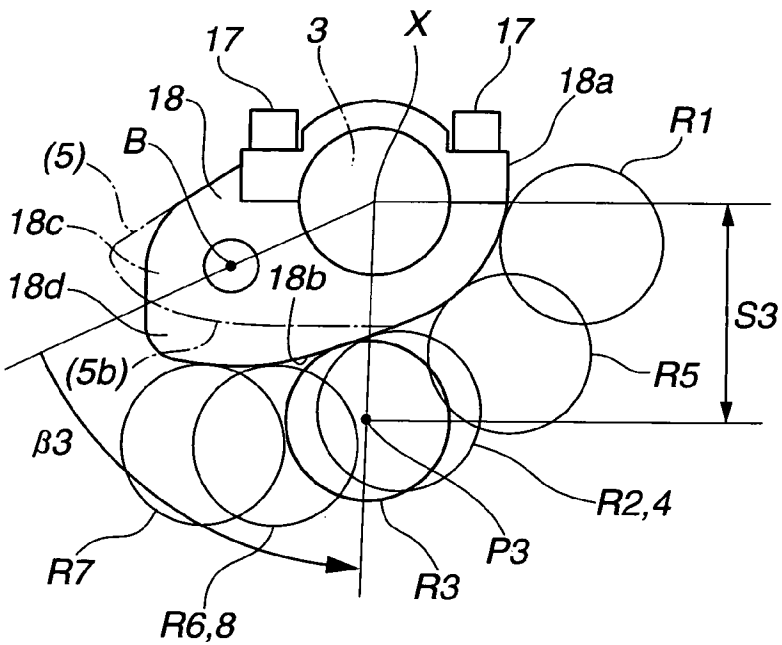
FIG. 5B is a schematic diagram showing a swing cam and a roller in the first embodiment of the valve operating apparatus which are disposed on a side of a left bank, and a trail of the roller rolling on a cam surface of the swing cam.
Figure 5A:
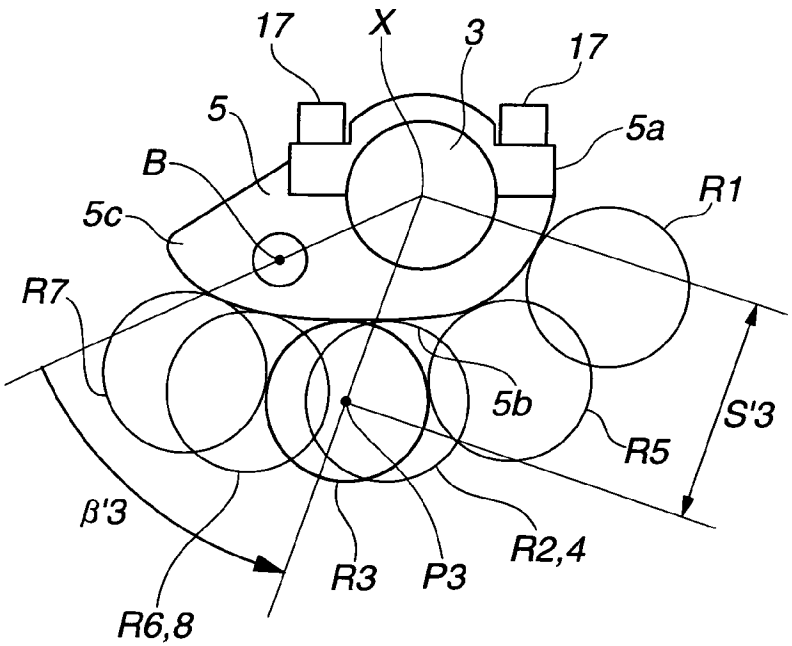
FIG. 5A is a schematic diagram showing a swing cam and a roller in the first embodiment of the valve operating apparatus which are disposed on a side of a right bank, and a trail of the roller rolling on a cam surface of the swing cam.

Specifically, as shown in FIG. 5B, cam surface 18*b* of swing cam 18 extends from larger base portion 18*a* toward cam nose portion 18*c* through lift portion 18*d*. Lift portion 18*d* is projected farther than cam nose portion 18*c* in a radial direction of drive shaft 3. Cam surface 18*b* is outward bulged larger than cam surface 5*b* of swing cam 5 such that a distance from the axis of swing cam 5 is increased and lift portion 18*d* is spaced from the axis of swing cam 5 further than cam nose portion 18*c*. The cam profile of cam surface 18*b* which is different from the cam profile of cam surface 5*b* is configured to provide the same valve lift curves of intake valves 2, 2 on the respective sides of right and left banks B1 and B2 during the operation of the valve operating apparatus. This is because there occurs a difference between the valve lift curve of intake valves 2, 2 on the side of left bank B2 and the valve lift curve of intake valves 2, 2 on the side of right bank B1 due to the layout of the valve actuating mechanisms and the variable operation mechanisms on the respective sides of right and left banks B1 and B2. A method for determining the cam profile of cam surface 18*b* will be specifically explained later.

Each of swing arms 6, 6 which serves as a valve actuating member has one end contacted with intake valve 2 and the other end contacted with pivot 11 which is supported by cylinder head 1. As best shown in FIG. 3, each of swing arms 6, 6 is formed into a generally bell-crank shape and includes a shorter arm which has contact portion 6*a* at a tip end portion thereof and a longer arm which has recessed portion 6*b* on an underside surface of a tip end portion thereof. A top of valve stem 2*a* of the corresponding intake valve 2 is contacted with contact portion 6*a*. Pivot 11 which serves as a fulcrum of the swing motion of swing arm 6 is contacted with recessed portion 6*b*. Swing arm 6 further includes through bore 6*c* which vertically extends through a generally middle portion between the shorter arm and the longer arm. Roller 12 is rotatably disposed in through bore 6*c*. Roller 12 comes into contact with cam surface 5*b* of swing cam 5 and acts as a cam follower relative to swing cam 5.

Pivot 11 is of a so-called hydraulic lash adjuster as shown in FIG. 4. Pivot 11 includes closed-ended cylindrical body 13 fixedly fitted to mount hole 1*a* that is formed in an upper end portion of cylinder head 1. Pivot 11 further includes cylindrical retainer 14 disposed in an inside-lower portion of body 13, and plunger 15 which is axially slidably disposed in an upper portion of retainer 14 and has a spherical head contacted with the recessed portion of swing arm 6. The valve actuating mechanism includes intake valves 2, 2, swing arms 6, 6 and pivots 11, 11. Meanwhile, the valve actuating member on the side of right bank B1 and the valve actuating member on the side of left bank B2 may have the constructions different from each other.

As shown in FIGS. 1-3, motion transmission mechanism 7 on the side of right bank B1 is arranged between drive cam 4 and each of swing cams 5, 5 to transmit torque of drive cam 4 to swing cams 5, 5. Specifically, motion transmission mechanism 7 is operative to convert a rotary motion of drive cam 4 to a swing motion of swing cams 5, 5. Motion transmission mechanism 7 includes rocker arm 20 which is arranged above drive shaft 3, link arm 21 which pivotally connects first arm portion 20*a* of rocker arm 20 to drive cam 4, and a pair of link rods 22, 22 which pivotally connect two second arm portions 20*b*, 20*b* of rocker arm 20 to two swing cams 5, 5. Thus, rocker arm 20, link arm 21 and link rods 22, 22 constitute a so-called multi-articulated link arrangement.

Specifically, rocker arm 20 has cylindrical support bore 20*c* that extends through a middle base portion of rocker arm 20. Support bore 20*c* receives therein control cam 27 as explained later, such that rocker arm 20 is swingably supported by control cam 27. First arm portion 20*a* of rocker arm 20 is formed with a pin insertion hole in which connection pin 23 is slidably received. As best shown in FIG. 1, second arm portions 20*b*, 20*b* of rocker arm 20 are formed into a bifurcated shape corresponding to the two swing cams 5, 5.

Bifurcated second arm portions 20*b*, 20*b* of rocker arm 20 are symmetrically arranged with respect to the middle base portion of rocker arm 20. Each of second arm portions 20*b*, 20*b* has a pin insertion hole in a leading end portion thereof through which connection pin 24 extends. The leading end portion of second arm portion 20*b* is pivotally connected with upper end portion 22*a* of each of link rods 22, 22 through connection pin 24. Snap rings, not shown, are mounted to both ends of respective connection pins 23 and 24 to thereby prevent connection pins 23 and 24 from removing from the corresponding pin insertion holes. These two second arm portions 20*b* and 20*b* of rocker arm 20 are arranged to transmit a swinging force to two swing cams 5, 5 from an upward position in a gravitational direction through link rods 22, 22.

Link arm 21 includes larger annular portion 21*a* and arm portion 21*b* that projects radially outward from a predetermined part of annular portion 21*a*. Larger annular portion 21*a* has circular engaging opening 21*c* at a central part thereof into which drive cam 4 is rotatably fitted. Arm portion 21*b* is pivotally connected with first arm portion 20*a* of rocker arm 20 through connection pin 23 which is received in a pin insertion hole formed in arm portion 21*b*.

Each of link rods 22, 22 is shaped like a cradle, which is constructed by press-forming a metal plate. Link rod 22 includes opposite end portions 22*a* and 22*b* each including spaced two side walls, and a middle bridge portion through which end portions 22*a* and 22*b* are integrally connected with each other. One end portion 22*a* is pivotally connected with second arm portion 20*b* of rocker arm 20 through connection pin 24. The other end portion 22*b* is pivotally connected with cam nose portion 5*c* of swing cam 5 through connection pin 25 which is received in a pin insertion hole formed in the other end portion 22*b*. Snap rings, not shown, are mounted to both ends of connection pin 25 to thereby prevent connection pin 25 from removing from the corresponding pin insertion hole.

Control mechanism 8 is constructed to vary an operating position of motion transmission mechanism 7 and thereby control the valve lift amount and the operating angle of intake valves 2, 2. Control mechanism 8 includes control shaft 26 which is arranged above drive shaft 3, and control cam 27 which is integrally formed on an outer circumferential periphery of control shaft 26. Control shaft 26 is rotatably supported by upper end portions of the bearing members which are fixed to cylinder head 1 and support drive shaft 3. Control cam 27 is received in support bore 20*c* of rocker arm 20 and serves as a fulcrum of the swing motion of rocker arm 20.

Control shaft 26 extends in parallel with drive shaft 3 and in the longitudinal direction of the engine. Control shaft 26 is supported over a relatively long span by the bearings. Control shaft 26 has one end that is connected to an electric actuator, viz., DC motor, through a gear mechanism. Control shaft 26 is controlled by the electric actuator so as to be turned in both directions about an axis thereof within a given angular range. Control cam 27 has a cylindrical shape and serves as an eccentric cam. That is, as shown in FIG. 3, control cam 27 has axis P1 displaced from axis P2 of control shaft 26 by a predetermined distance as indicated at "e".

The electric actuator is controlled by a controller which outputs various instruction signals by processing various information signals with respect to an engine operating condition. Actually, the controller has a microcomputer that includes CPU, RAM, ROM and suitable interfaces. For collecting the information signals, various sensors, such as a crank angle sensor, an air flow meter, an engine cooling water temperature sensor, a potentiometer which detects the angular position of control shaft 26 and the like are used. That is, by processing such information signals, the controller outputs a suitable instruction signal to the electric actuator to control the same.

Figures 6A, 6B, 6C, 6D:
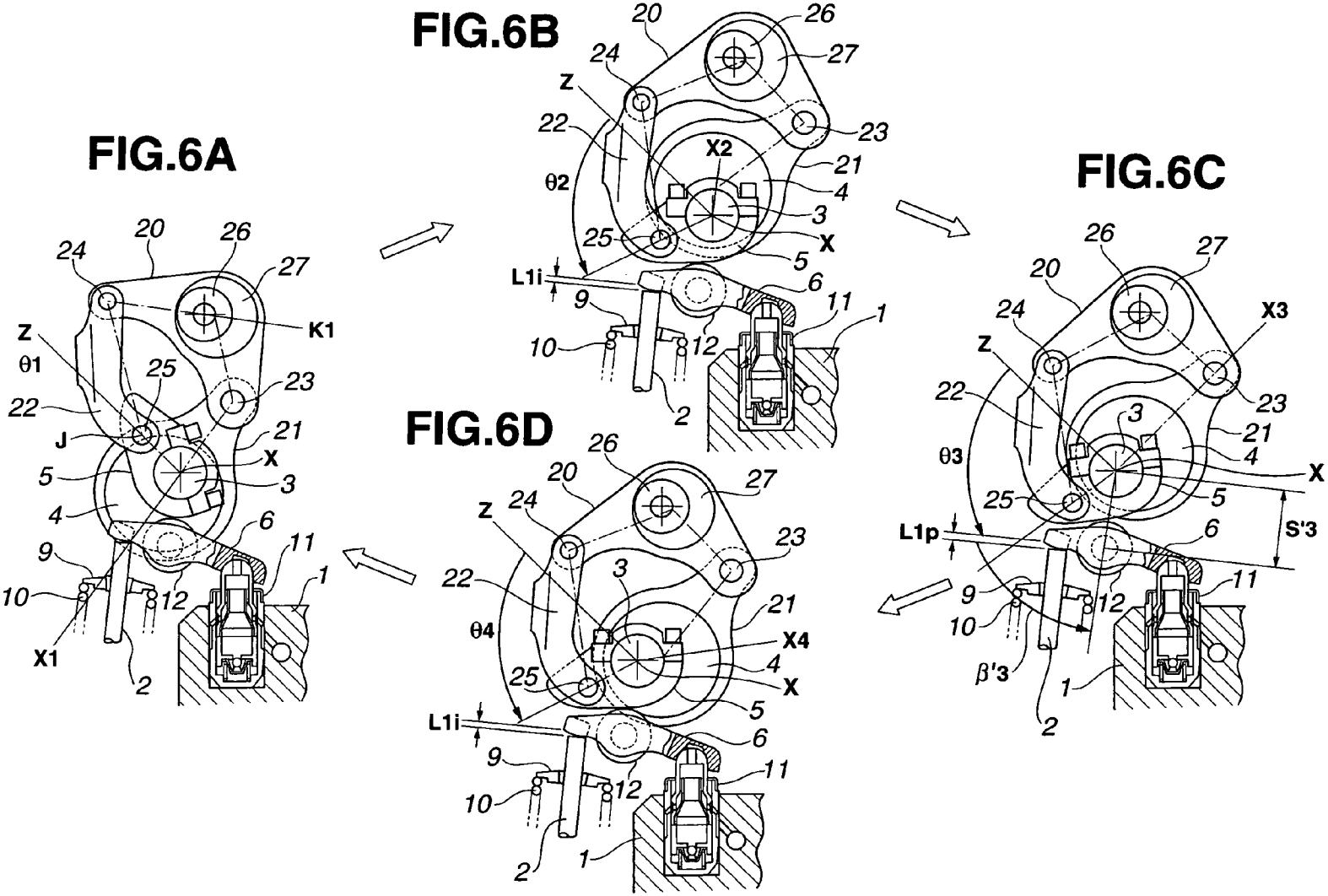
FIGS. 6A-6D are explanatory diagrams showing an operation of the first embodiment of the valve operating apparatus on the side of the right bank under minimum lift control.

In the following, an operation of the valve operating apparatus of the first embodiment will be briefly described with reference to FIGS. 6A-10. FIGS. 6A-6D show the operation of the valve actuating mechanism and the variable operation mechanism on the side of right bank B1 upon the engine operation in a low speed range, and FIGS. 8A-8D show the operation of the valve actuating mechanism and the variable operation mechanism on the side of left bank B2 upon the engine operation in the low speed range. The controller controls the electric actuator to turn respective control shafts 26, 26 in one direction, namely, in a counterclockwise direction. As shown in FIGS. 6A and 8A, respective control cams 27, 27 integral with respective control shafts 26, 26 are turned in the one direction such that thickest parts thereof take a rotation angle position as indicated at K1 and kept in the position K1.

With the turning of respective control cams 27, 27, second arm portions 20*b*, 20*b* of respective rocker arms 20, 20 are lifted upward, and cam nose portions 5*c* and 18*c* of respective swing cams 5 and 18 are pulled up through respective link rods 22, 22. Thus, swing cams 5 and 18 are forced to rotate in a clockwise direction and keep the angular positions as shown in FIGS. 6B and 8B.

When rotation of respective drive cams 4, 4 causes respective link arms 21, 21 to push up first arm portion 20*a* of respective rocker arms 20, the lifting force applied to rocker arms 20 is transmitted to swing arms 6, 6 through link rods 22, 22, swing cams 5 and 18 and rollers 12, 12. As shown in FIGS. 6C and 8C, swing arms 6, 6 are thus forced to swing downward about the spherical heads of plungers 15, 15 of respective pivots 11, 11 and press respective valve stems 2*a*, 2*a* at their contact portions 6*a*, 6*a*. With the downward movement of valve stems 2*a*, 2*a*, the corresponding intake valves 2, 2 are forced to open so as to provide a minimum valve lift amount. The minimum lift control of intake valves 2, 2 is thus carried out.

Figure 10:
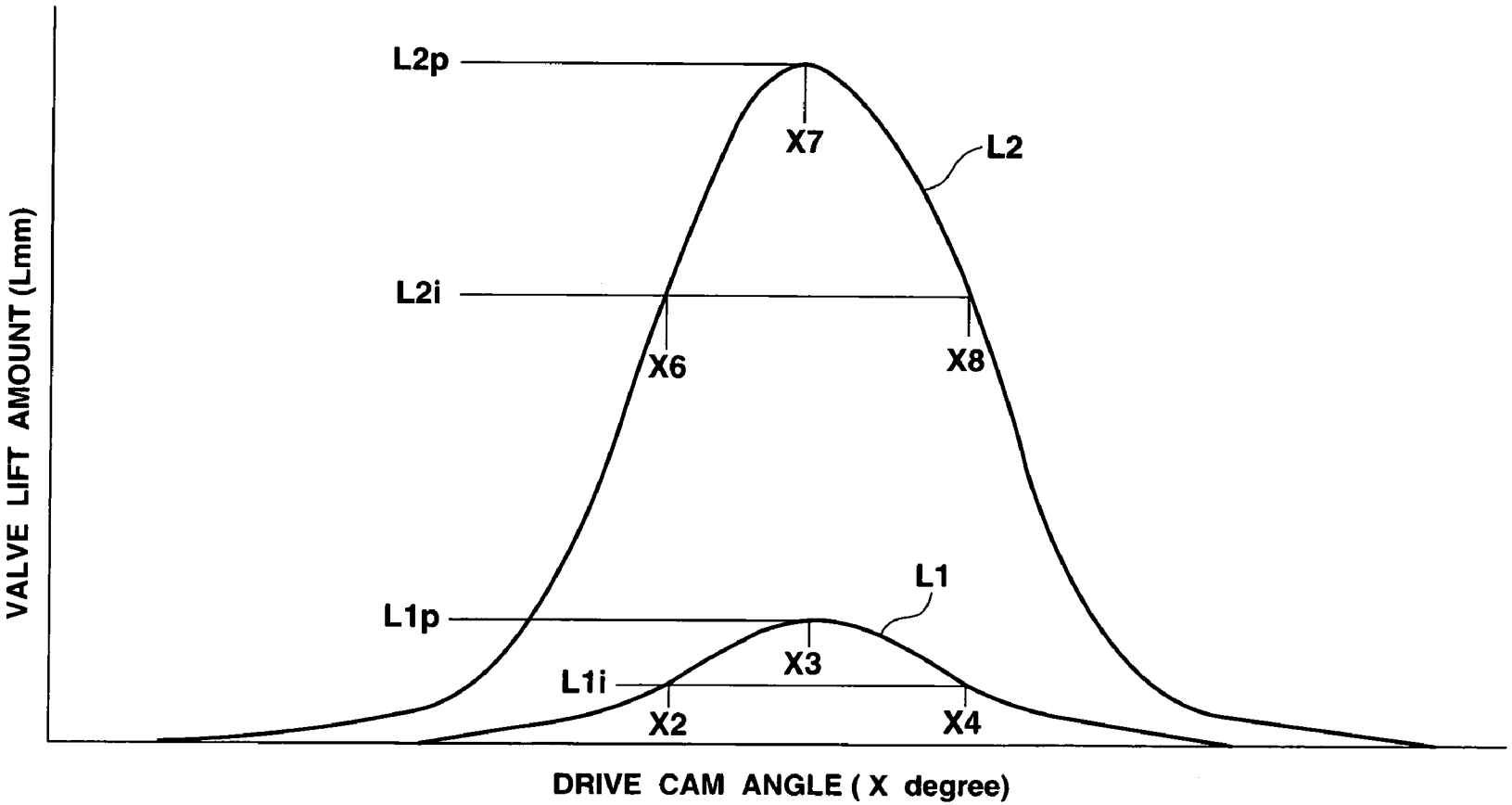
FIG. 10 is a characteristic diagram showing a valve lift curve of engine valves on the respective sides of the right and left banks which is provided in the first embodiment of the valve operating apparatus.

FIG. 10 illustrates valve lift curve L1 which is provided under the minimum lift control. As seen from valve lift curve L1 in FIG. 10, the valve lift amount is a minimum and the valve open timing is retarded to thereby reduce a valve overlap in which the open durations of intake valves 2, 2 and exhaust valves are overlapped. Therefore, the minimum lift control can provide, for instance, stable engine rotation and enhanced fuel economy in a low load range.

Figures 7A, 7B, 7C, 7D:
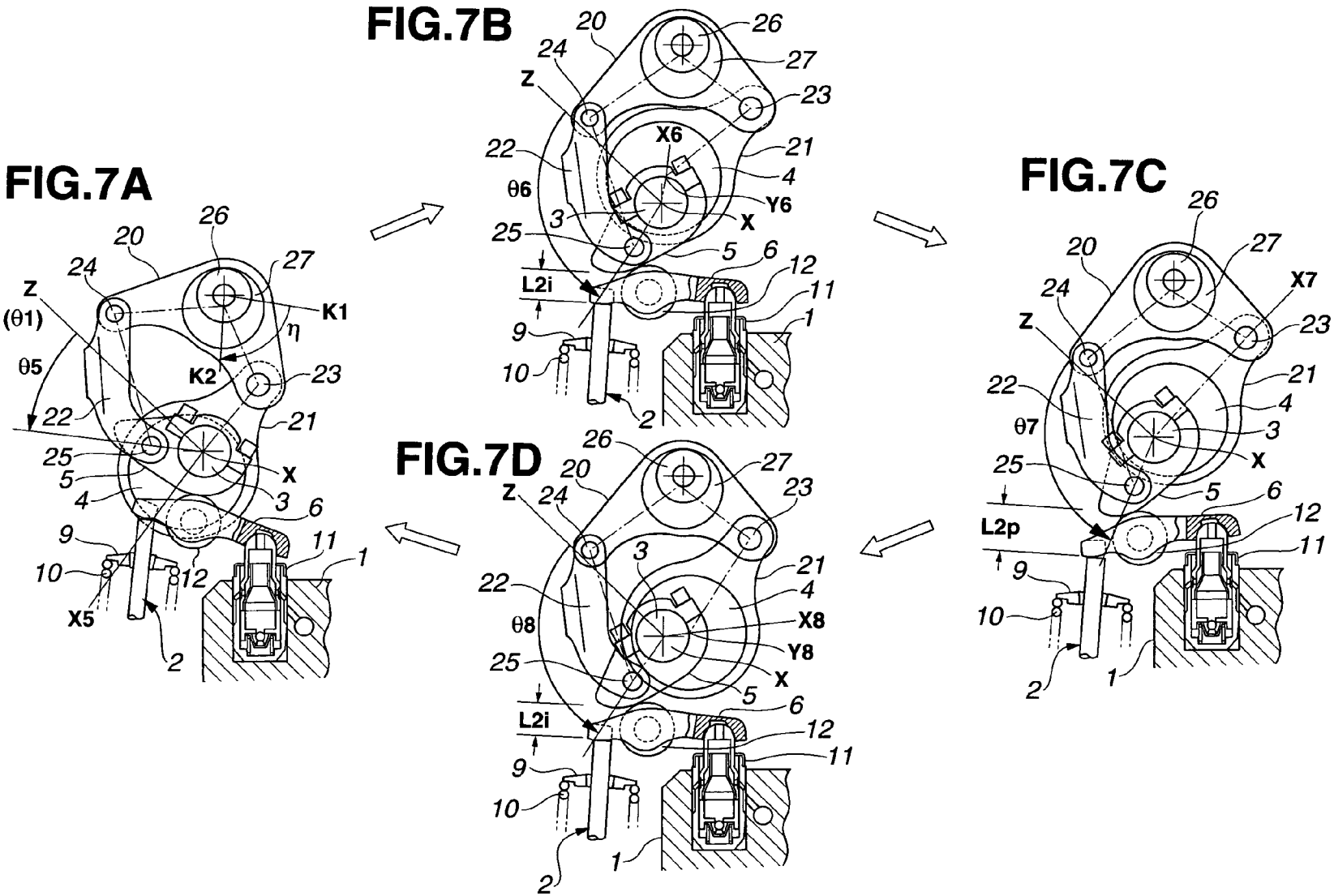
FIGS. 7A-7D are explanatory diagrams showing an operation of the first embodiment of the valve operating apparatus on the side of the right bank under maximum lift control.
Figures 8A, 8B, 8C, 8D:
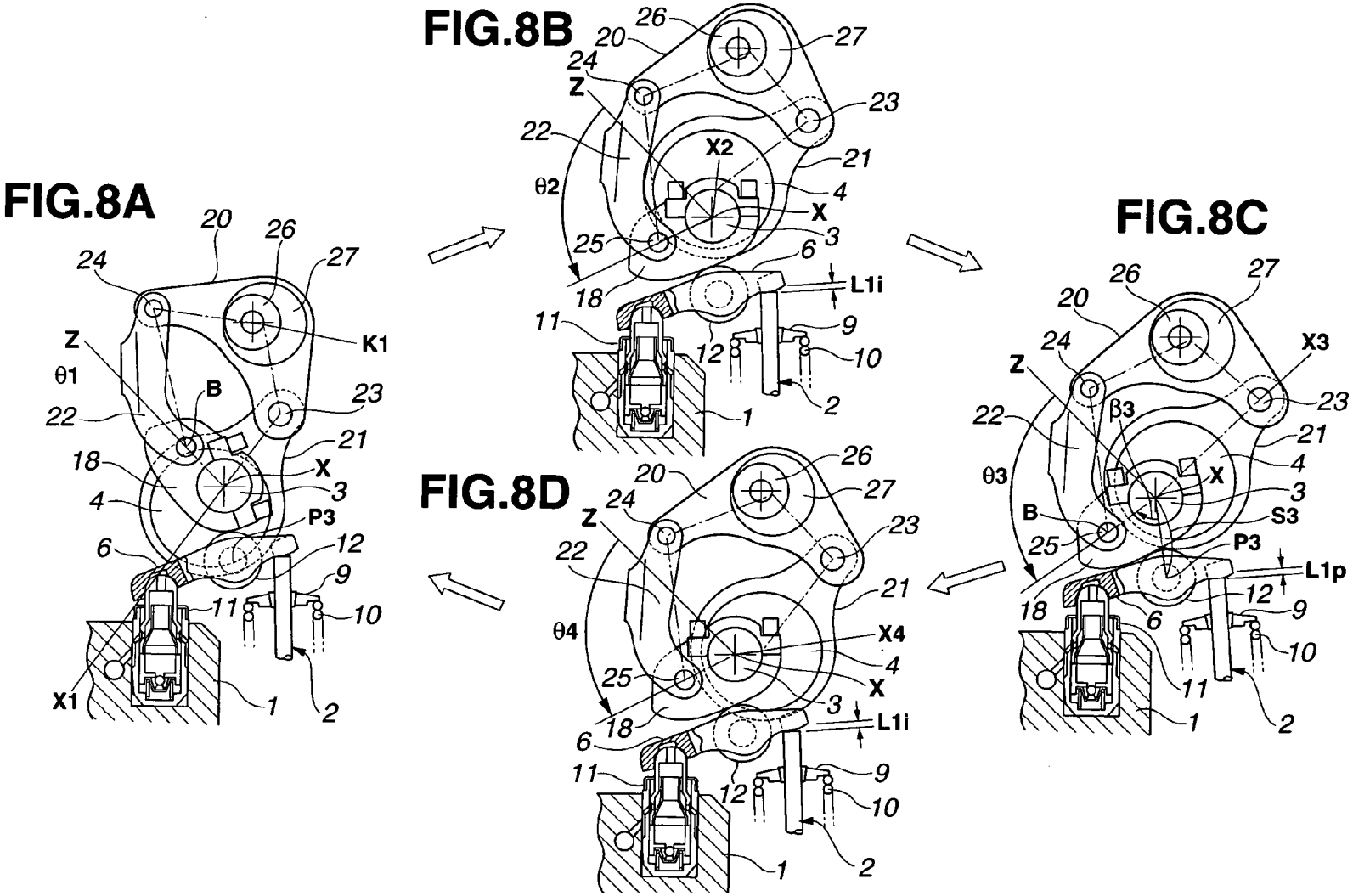
FIGS. 8A-8D are explanatory diagrams showing an operation of the first embodiment of the valve operating apparatus on the side of the left bank under minimum lift control.
Figures 9A, 9B, 9C, 9D:
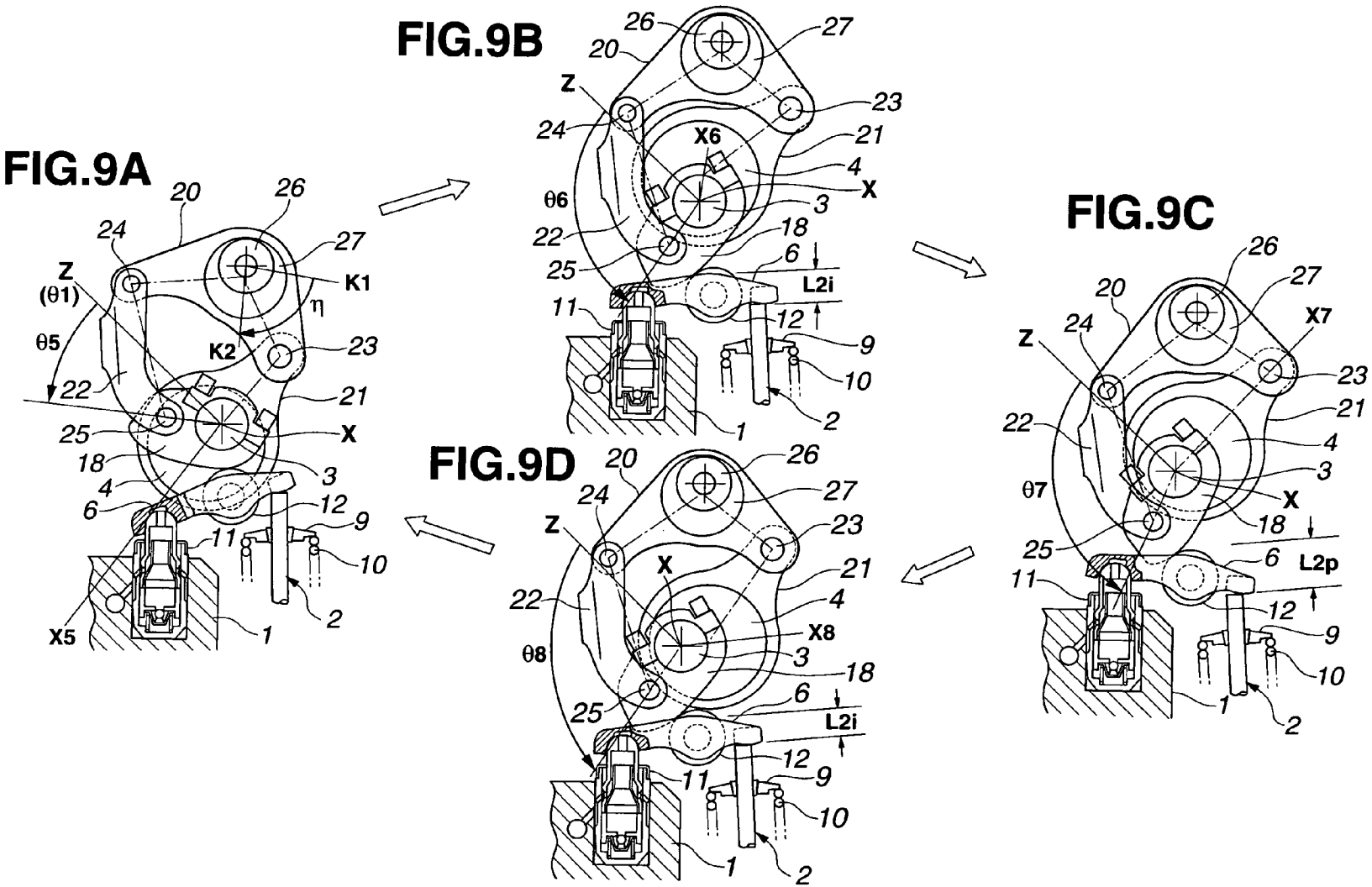
FIGS. 9A-9D are explanatory diagrams showing an operation of the first embodiment of the valve operating apparatus on the side of the left bank under maximum lift control.

On the other hand, when the engine operation is shifted to the high speed range, the valve operating apparatus of the first embodiment on the side of right bank B1 is operated as shown in FIGS. 7A-7D and the valve operating apparatus thereof on the side of left bank B2 is operated as shown in FIGS. 9A-9D. As shown in FIGS. 7A and 9A, the electric actuator is controlled by the controller so as to turn respective control shafts 26, 26 in an opposite direction to the above-described one direction, namely, in a clockwise direction, by angle η. Respective control cams 27, 27 integral with respective control shafts 26, 26 are thus turned in the clockwise direction and placed in a predetermined rotation angle position K2 in which thickest parts thereof take a lower position. With this turning of control cams 27, 27, second arm portions 20*b* and 20*b* of respective rocker arms 20, 20 are turned downward so that cam nose portions 5*c* and 18*c* of respective swing cams 5 and 18 are pushed down through respective link rods 22 and 22. Swing cams 5 and 18 are forced to rotate in the counterclockwise direction and keep the angular positions as shown by FIGS. 7B and 9B. Thus, the contact positions where cam surfaces 5*b* and 18*b* of respective swing cams 5 and 18 are in contact with respective rollers 12 and 12 of the corresponding swing arms 6, 6 are displaced to the side of cam nose portions 5*c* and 18*c* of respective swing cams 5 and 18.

When rotation of respective drive cams 4, 4 causes respective link arms 21 to push up first arm portion 20*a* of respective rocker arms 20, 20 so that second arm portions 20*b* of respective rocker arms 20, 20 push down link rods 22 and 22, respective swing cams 5 and 18 press respective rollers 12 and 12 at the tip end portions of cam nose portions 5*c* and 18*c* as shown in FIGS. 7C and 9C. Thus, the swing amount of swing arms 6, 6 is increased to thereby cause a maximum valve lift amount of intake valves 2, 2.

FIG. 10 shows valve lift curve L2 which is obtained under the maximum lift control. As seen from valve lift curve L2, the valve lift amount is maximum and the valve open timing is advanced and the valve closing timing is retarded. Therefore, the maximum lift control can provide, for instance, increased intake charging efficiency and sufficient power in a high load range.

It should be noted that the large lift control and the small lift control by control mechanism 8 can be continuously carried out from the minimum lift (L1) to the maximum lift (L2) in accordance with an operating condition of the engine.

Next, referring to FIGS. 6A-6D and FIGS. 7A-7D, asymmetrical characteristic of the valve lift curve of intake valves 2, 2 on the side of right bank B1 with respect to a peak lift point will be explained hereinafter on the basis of the operation of the valve operating apparatus of the first embodiment under the minimum lift control and the maximum lift control.

FIGS. 6A-6D show the minimum lift control operation of the valve actuating mechanism and the variable operation mechanism on the side of right bank B1. FIG. 6A shows a non-lift position of intake valve 2 in which swing cam 5 is located in the most swing-up position where cam nose portion 5*c* is placed in an upper-most position. In the most swing-up position of swing cam 5, swing cam 5 is placed in a swing angle position indicated by line Z which is drawn across central axis X of drive shaft 3 as a fulcrum of the swing motion of swing cam 5 and connection point J between swing cam 5 and link rod 22. In this swing angle position, swing cam 5 has reference swing angle θ1. Drive cam 4 is located in an angular position with rotation angle X1 which is formed around central axis X of drive shaft 3. It should be noted the rotation angle of drive cam 4 means the rotation angle of drive shaft 3. As shown in FIG. 6B, when drive cam 4 is rotated in the clockwise direction and has rotation angle X2 and swing cam 5 has swing angle θ2, the valve lift amount of intake valve 2 becomes medium lift L1*i* in the up-lift motion.

As shown in FIG. 6C, when drive cam 4 is then rotated and has rotation angle X3 and swing cam 5 has swing angle θ3, the valve lift amount of intake valve 2 becomes peak lift L1*p*. As shown in FIG. 6D, when drive cam 4 is then rotated and has rotation angle X4 and swing cam 5 has swing angle θ4 that is equal to swing angle θ2, the valve lift amount of intake valve 2 becomes again medium lift L1*i* in the up-lift motion. Further, when drive cam 4 is further rotated and returned to the initial position as shown in FIG. 6A which corresponds to rotation angle X1 and swing cam 5 is returned to the swing angle position corresponding to reference swing angle θ1, intake valve 2 is returned to the non-lift position. Thus, under the minimum lift control, one cycle of the rotational motion of drive cam 4 and the swing motion of swing cam 5 is ended.

FIGS. 7A-7D show the maximum lift control operation of the valve actuating mechanism and the variable operation mechanism on the side of right bank B1. FIG. 7A shows a non-lift position of intake valve 2 in which drive cam 4 has rotation angle X5 and swing cam 5 has swing angle θ5. As shown in FIG. 7B, when drive cam 4 is rotated in the clockwise direction and has rotation angle X6 and swing cam 5 has swing angle θ6, the valve lift amount of intake valve 2 becomes medium lift L2*i* in the up-lift motion. As shown in FIG. 7C, when drive cam 4 is then rotated and has rotation angle X7 and swing cam 5 has swing angle θ7, the valve lift amount of intake valve 2 becomes peak lift L2*p*. As shown in FIG. 7D, when drive cam 4 is then rotated and has rotation angle X8 and swing cam 5 has swing angle θ8 that is equal to swing angle θ6, the valve lift amount of intake valve 2 becomes again medium lift L2*i* in the up-lift motion. Further, as shown in FIG. 7A, when drive cam 4 is then rotated and returned to the angular position with rotation angle X5 and swing cam 5 is returned to the swing angle position with swing angle θ5, intake valve 2 is returned to the non-lift position. Thus, under the maximum lift control, one cycle of the rotational motion of drive cam 4 and the swing motion of swing cam 5 is ended.

Next, the reason for occurrence of the asymmetrical characteristic of the valve lift curve with respect to the peak lift as shown in FIG. 10 is considered on the basis of the above-described operation of the valve operating apparatus of the first embodiment.

As shown in FIG. 10, valve lift curve L1 which is provided under the minimum lift control as shown in FIGS. 6A-6D includes a lift-up portion between two points X2 and X3 and a lift-down portion between two points X3 and X4. The lift-up portion between points X3-X2 and the lift-down portion between points X4-X3 are asymmetrical with respect to a normal to valve lift curve L1 which extends through point X3 where the peak lift is provided. That is, the lift-up portion between points X3-X2 and the lift-down portion between points X4-X3 are unequal to each other. Similarly, valve lift curve L2 which is provided under the maximum lift control as shown in FIGS. 7A-7D includes a lift-up portion between two points X6 and X7 and a lift-down portion between two points X7 and X8. The lift-up portion between points X7-X6 and the lift-down portion between points X8-X7 are asymmetrical with respect to a normal to valve lift curve L2 which extends through point X7 where the peak lift is provided. That is, the lift-up portion between points X7-X6 and the lift-down portion between points X8-X7 are unequal to each other.

Specifically, for instance, as seen from FIGS. 7B and 7D showing the maximum lift control, when the same medium lift L2*i* is provided, swing cam 5 has swing angles θ6 and θ8 which are equal to each other. However, when swing cam 5 has the equal swing angles θ6 and θ8 in which the same medium lift L2*i* is provided, drive cam 4 has rotation angles X6 and X8 different from each other. Rotation angle X6 of drive cam 4 corresponds to a direction of line segment X-Y6 through central axis Y6 of drive cam 4 and central axis X of drive shaft 3, and rotation angle X8 of drive cam 4 corresponds to a direction of line segment X-Y8 through central axis Y8 of drive cam 4 and central axis X of drive shaft 3.

Figure 11:
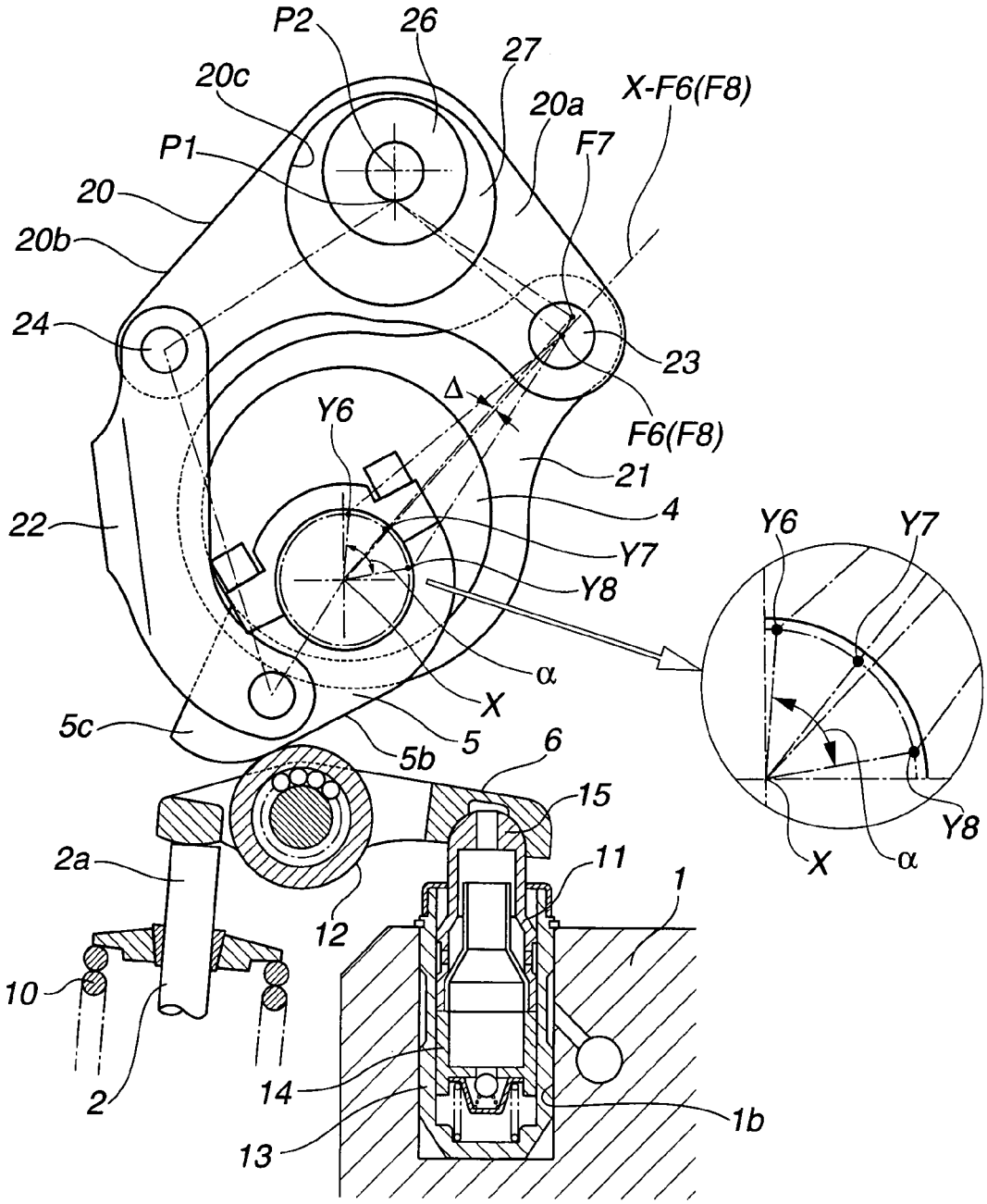
FIG. 11 is an explanatory diagram for explaining an asymmetric valve lift curve with respect to a peak lift, and shows a cross section of the essential part of the first embodiment of the valve operating apparatus and a partially enlarged view thereof in a circle.

Rotation angles X6, X7 and X8 of drive cam 4 are explained by referring to FIG. 11. In FIG. 11, there are shown the directions of line segments X-Y6, X-Y7 and X-Y8, when the valve lift is varied between medium lift L2*i* and peak lift L2*p* under the maximum lift control as shown in FIGS. 7B, 7C and 7D. Point F6 denotes a position of a central axis of connection pin 23 which serves as a connection point between rocker arm 20 and link arm 21, when medium lift L2*i* is provided as shown in FIG. 7B, and point F8 denotes a position of the central axis of connection pin 23 when medium lift L2*i* is provided as shown in FIG. 7D. Points F6 and F8 are aligned with each other. Point F7 denotes a position of the central axis of connection pin 23 when peak lift L2*p* is provided as shown in FIG. 7C. Points F6, F8 and F7 are located on a circumference of a circle having a center that is placed on axis P1 of control cam 27. Point Y6 denotes a position of central axis Y of drive cam 4 when medium lift L2*i* is provided as shown in FIG. 7B, and point Y8 denotes a position of central axis Y of drive cam 4 when medium lift L2*i* is provided as shown in FIG. 7D. As shown in FIG. 11, point Y6 and point Y8 are symmetric with respect to line segment X-F6 which is equal to line segment X-F8. Accordingly, angle ∠Y6-X-Y8 between line segment Y6-X and line segment Y8-X is divided by line segment X-F6 and X-F8 into equal halves which are angle ∠Y6-X-F6 between line segment Y6-X and line segment X-F6 and angle ∠Y8-X-F8 between line segment Y8-X and line segment X-F8. Angle ∠Y6-X-Y8 is indicated by a as shown in FIG. 11. Angle α corresponds to a difference X8–X6 between rotation angles X8 and X6 of drive cam 4 as shown in FIG. 10. Therefore, angle ∠Y6-X-F6 and angle ∠Y8-X-F8 are ½ of angle α which corresponds to ½ of the difference X8–X6 between rotation angles X8 and X6 of drive cam 4.

Next, if connection point F between rocker arm 20 and link arm 21 is located in position F7 as shown in FIG. 11 when peak lift L2*p* is provided as shown in FIG. 7C, line segment X-F7 is offset from line segment X-F6 or line segment X-F8, by angle Δ in the counterclockwise direction. The offset of line segment X-F7 from line segment X-F6 or line segment X-F8 is caused because connection point F is displaced when peak lift L2*p* is provided. Therefore, the occurrence of the offset is inevitable due to the operating characteristic of multi-link motion transmission mechanism 7. Here, angle ∠Y6-X-F7 between line segment Y6-X and line segment F7-X is angle (α/2−Δ) which is obtained by subtracting angle Δ from ½ of angle α. The angle (α/2−Δ) corresponds to a difference X7–X6 between rotation angles X7 and X6 of drive cam 4 as shown in FIG. 10. Angle ∠Y8-X-F7 between line segment Y8-X and line segment F7-X is angle (α/2+Δ) which is obtained by adding angle Δ to ½ of angle α. The angle (α/2+Δ) corresponds to a difference X8–X7 between rotation angles X8 and X7 of drive cam 4 as shown in FIG. 10.

Accordingly, the difference X7–X6 between rotation angles X7 and X6 of drive cam 4 is smaller than the difference X8–X7 between rotation angles X8 and X7 of drive cam 4. Thus, the difference X7–X6 is unequal to the difference X8–X7. Therefore, it is understood that the lift-up portion of valve lift curve L2 in FIG. 10 which corresponds to the difference X7–X6, and the lift-down portion thereof which corresponds to the difference X8–X7 are not identical in shape, i.e., asymmetrical with respect to the normal to valve lift curve L2 which extends through rotation angle X7 where peak lift L2*p* is provided under the maximum lift control. Similarly, the difference X3–X2 between rotation angles X3 and X2 of drive cam 4 is smaller than the difference X4–X3 between rotation angles X4 and X3 of drive cam 4, and thus the difference X3–X2 is unequal to the difference X4–X3. It is understood that the lift-up portion of valve lift curve L1 in FIG. 10 which corresponds to the difference X3–X2 and the lift-down portion thereof which corresponds to the difference X4–X3 are not identical in shape to each other, i.e., asymmetrical with respect to the normal to valve lift curve L1 which extends through point X3 where peak lift L2*p* is provided under the minimum lift control.

Figure 16:
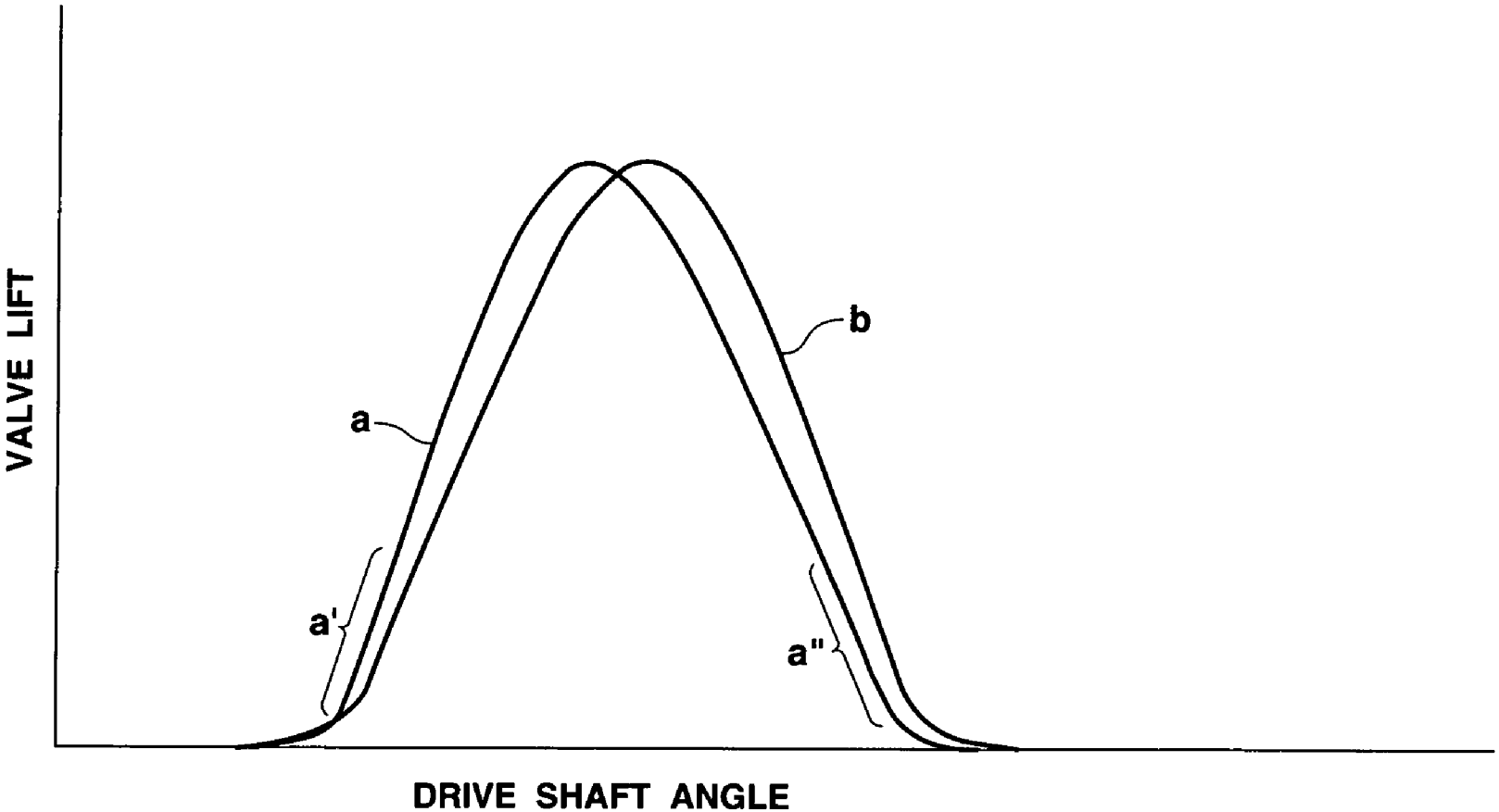
FIG. 16 is a characteristic diagram showing valve lift curves of intake valves on right and left banks in a conventional V-type internal combustion engine.

As discussed above, since the asymmetrical characteristic of the valve lift curve is caused due to the operating characteristic of motion transmission mechanism 7, it may be difficult that the asymmetrical characteristic of the valve lift curve can be eliminated. Therefore, if the valve actuating mechanisms and the variable operation mechanisms on the right and left banks are arranged in a mirror-symmetrical relation to each other with respect to the bank centerline, and drive shafts 3, 3 on the respective banks are rotated in the same direction, the valve lift curves of the intake valves on the right and left banks have a reversed relation to each other to thereby be out of alignment with each other similar to the valve lift curves "a" and "b" of the above-described conventional art as shown in FIG. 16. As a result, in such a case, there will be provided the valve lift curves different from each other between the right bank and the left bank.

Referring to FIGS. 12A-12D and FIGS. 13A-13D, there is shown a reference case wherein swing cam 118 on the side of left bank B2 which has cam surface 118*b* with the same cam profile as that of cam surface 5*b* of swing cam 5 on the side of right bank B1 would be used in the valve operating apparatus of the first embodiment. In this reference case, similar to the first embodiment, the valve actuating mechanisms on the respective sides of right and left banks B1 and B2 are arranged in the mirror-symmetric relation to each other with respect to the bank centerline, and the variable operation mechanisms on the respective sides of right and left banks B1 and B2 are arranged in the parallel relation to each other with respect to the bank centerline. FIGS. 12A-12D and FIGS. 13A-13D show the minimum lift control operation and the maximum lift control operation, respectively.

Figures 12A, 12B, 12C, 12D:
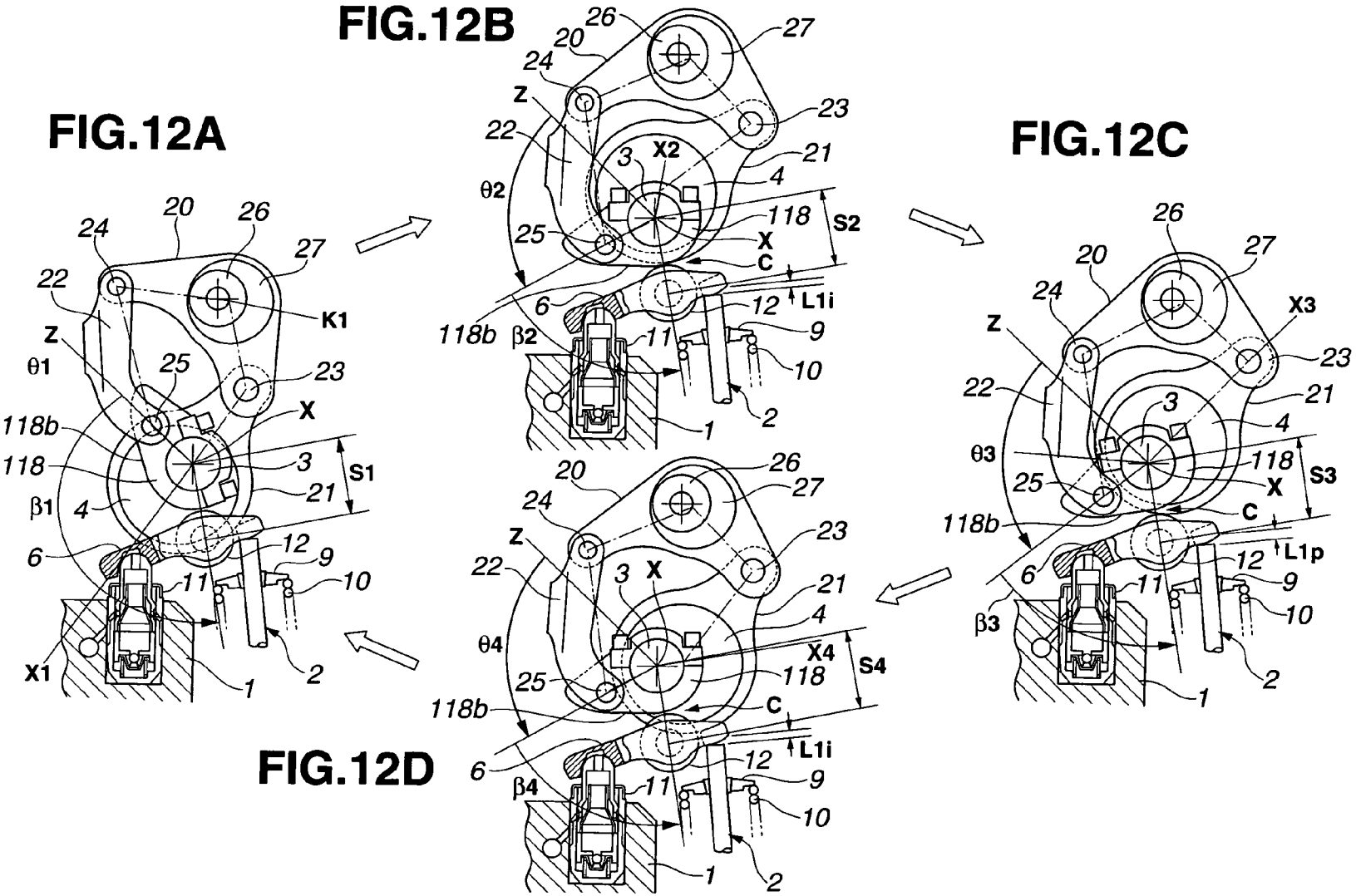
FIGS. 12A-12D are explanatory diagrams showing a minimum lift control operation of a valve operating apparatus as a reference case in which a swing cam on the side of the left bank has the same cam profile as that of a swing cam on the side of the right bank.

Under the minimum lift control, motion transmission mechanism 7 on the side of left bank B2 as shown in FIGS. 12A-12D has the same attitude as that of motion transmission mechanism 7 on the side of right bank B1 as shown in FIGS. 6A-6D. Specifically, rotation angles X1-X4 of drive cam 4, the attitudes of links 20, 21, 22 of motion transmission mechanism 7 and the rotational positions of control cam 27 of control mechanism 8 on the side of left bank B2 are the same as those on the side of right bank B1. Therefore, swing angles θ1-θ4 of swing cam 118 are the same as those of swing cam 5. In this reference case, as shown in FIGS. 12B-12D, when medium lift L1*i* and peak lift L1*p* are provided, there is generated clearance C between cam surface 118*b* of swing cam 118 and the outer circumferential surface of roller 12 of swing arm 6. The occurrence of clearance C means that the valve lift which is provided on the side of left bank B2 upon operating motion transmission mechanism 7 on the side of left bank B2 becomes smaller than the valve lift which is provided on the side of right bank B1 upon operating motion transmission mechanism 7 on the side of right bank B1.

Figures 13A, 13B, 13C, 13D:
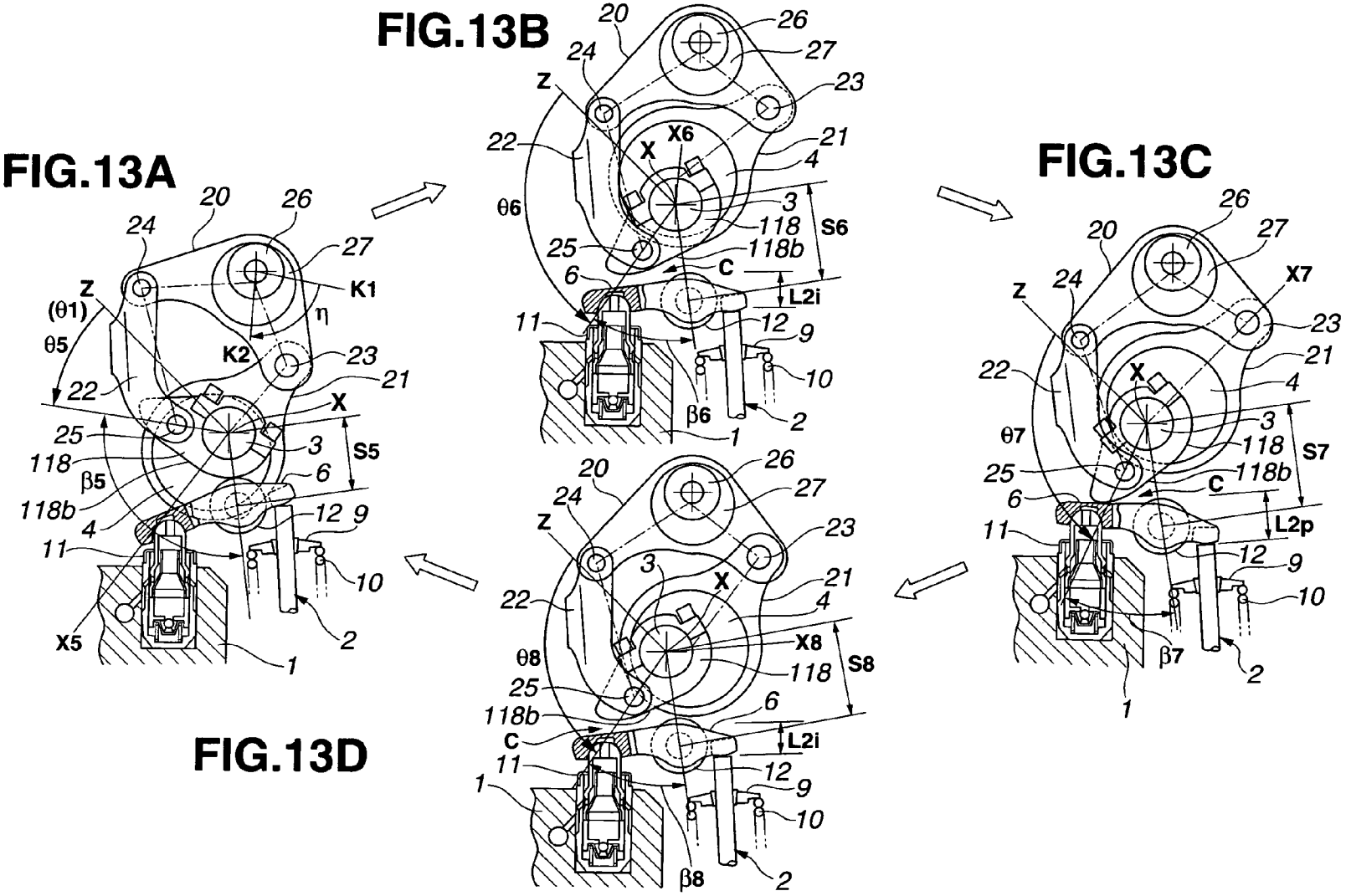
FIGS. 13A-13D are explanatory diagrams similar to FIGS. 12A-12D but show a maximum lift control operation of the valve operating apparatus.

Under the maximum lift control, motion transmission mechanism 7 on the side of left bank B2 as shown in FIGS. 13A-13D has the same attitude as that of motion transmission mechanism 7 on the side of right bank B1 as shown in FIGS. 7A-7D. Specifically, rotation angles X5-X8 of drive cam 4, the attitudes of links 20, 21, 22 of motion transmission mechanism 7 and the rotational positions of control cam 27 of control mechanism 8 on the side of left bank B2 are the same as those on the side of right bank B1. Therefore, swing angles θ5-θ8 of swing cam 118 are the same as those of swing cam 5. As shown in FIGS. 13B-13D, when medium lift L2*i* and peak lift L2*p* are respectively provided, there is generated clearance C between cam surface 118*b* of swing cam 118 and the outer circumferential surface of roller 12 of swing arm 6. Accordingly, even under the maximum lift control in the reference case, the valve lift which is provided on the side of left bank B2 upon operating motion transmission mechanism 7 on the side of left bank B2 becomes smaller than the valve lift which is provided on the side of right bank B1 upon operating motion transmission mechanism 7 on the side of right bank B1.

It can be understood from the above reference case that the valve lift curves which are provided on the right and left bank sides are not identical to each other even if swing cam 118 having the same cam profile as that of swing cam 5 on the side of right bank B1 is used on the side of left bank B2.

Therefore, it is necessary to form a cam profile of the swing cam on the side of left bank B2 which can provide the same valve lift curve as the valve lift curve that is provided by the cam profile of swing cam 5 on the side of right bank B1. Here, it should be noted that if the swing angle of the swing cam having a cam profile is determined, the valve lift curve which is provided through a valve actuating mechanism can be specifically determined. Conversely, the cam profile of the swing cam on the side of left bank B2 can be determined on the basis of the valve lift curve which is provided through the valve actuating mechanism on the side of left bank B2.

Referring to FIG. 5B, the method of determining the cam profile of swing cam 18 on the side of left bank B2 will be explained hereinafter. The cam profile of swing cam 18 is set as an envelope which is drawn by arcuate loci of roller 12 of swing arm 6 which acts as a cam follower relative to swing cam 18 when intake valve 2 on the side of left bank B2 is operated to be open and closed. The envelope is determined on the basis of a distance between a center of curvature of each of the loci of the cam follower, i.e., a central axis of roller 12, and the axis of swing cam 18, and an angle which is formed between a line extending through the center of curvature of each of the loci of the cam follower and the axis of swing cam 18 and a line extending through the axis of swing cam 18 and a connection point between swing cam 18 and motion transmission mechanism 7.

Specifically, FIG. 5B shows contact positions between swing cam 18 on the side of left bank B2 and roller 12 of swing arm 6, with the assumption that swing cam 18 as shown in FIG. 8C is fixed in a coordinate system. In FIG. 5B, there are shown arcuate loci R1-R4 and R5-R8 of roller 12 of swing arm 6 which follows swing cam 18 when the swing angle of swing cam 18 is varied under the minimum lift control as shown in FIGS. 8A-8D and under the maximum lift control as shown in FIGS. 9A-9D. As shown in FIG. 5B, among loci R1-R4 which are made under the minimum lift control, loci R2 and R4 are the same in contact position relative to swing cam 18 because swing angle θ2 and θ4 are equal to each other. Among loci R5-R8 which are made under the maximum lift control, loci R6 and R8 are the same in contact position relative to swing cam 18 because swing angle θ6 and 08 are equal to each other.

Each of arcuate loci R1-R4 and R5-R8 as shown in FIG. 5B is drawn on the basis of a distance between the center of curvature of the cam follower, i.e., central axis P3 of roller 12, and the axis of swing cam 18, i.e., central axis X of drive shaft 3, and an angle between a line extending through central axis P3 of roller 12 and the axis of swing cam 18 and a line extending through the axis of swing cam 18 and connection point B between swing cam 18 and link rod 22. Locus R3 is drawn on the basis of distance S3 and angle β3 as shown in FIG. 8C. In FIG. 8C, distance S3 extends between central axis P3 of roller 12 and the axis of swing cam 18, and angle β3 is formed between line segment S3 through central axis P3 of roller 12 and the axis of swing cam 18 and a line through the axis of swing cam 18 and connection point B between swing cam 18 and link rod 22. Loci R1, R2 (R4), R5-R8 and other loci therebetween are drawn in the same manner as described above. The thus-drawn loci of roller 12 give the envelope as a curve which is aligned with the cam profile of cam surface 18*b* of swing cam 18 on the side of left bank B2. Accordingly, the cam profile of cam surface 18*b* of swing cam 18 on the side of left bank B2 can be set as the given envelope.

In the valve operating apparatus of the first embodiment, the operating characteristic of the valve actuating mechanism on the side of right bank B1 and the operating characteristic of the valve actuating mechanism on the side of left bank B2 are different from each other under the respective controls of minimum lift and maximum lift due to the mirror-symmetrical arrangement. In contrast, the operating characteristics of the variable operation mechanisms, namely, control mechanisms 8, 8 and motion transmission mechanisms 7, 7, on the respective sides of right and left banks B1 and B2 are the same under the respective controls of minimum lift and maximum lift. Therefore, swing motion characteristics of swing cams 5 and 18 on the respective sides of right and left banks B1 and B2 are the same, and the swing angles of swing cams 5 and 18 are the same. In this condition, swing cam 18 and the corresponding swing arm 6 as the valve actuating member cooperate with each other to provide the valve lift amount of intake valve 2 for one of the two groups of cylinders within left bank B2 with respect to the swing angle of swing cam 18 which is identical to the valve lift amount of intake valve 2 for the other of the two groups of cylinders within right bank B1 with respect to the swing angle of swing cam 5. In the first embodiment, swing cam 18 on the side of left bank B2 has the cam profile which is different from the cam profile of swing cam 5 on the side of right bank B1 so as to provide the valve lift amount of intake valve 2 on the side of left bank B2 which is identical to the valve lift amount of intake valve 2 on the side of right bank B1. That is, by setting the cam profile of swing cam 18 as the envelope determined in the above-described manner, the valve lift amount on the side of left bank B2 can be identical to the valve lift amount on the side of right bank B1. Accordingly, there can be provided the same valve lift curve of intake valve 2 between the one of the two groups of cylinders within left bank B2 and the other of the two groups of cylinders within right bank B1.

If an envelope is drawn as shown in FIG. 5B on the basis of loci of roller 12, i.e., distances S1-S4 and angles β1-β4 as shown in FIGS. 12A-12D and distances S5-S8 and angles β5-β8 as shown in FIGS. 13A-13D, the thus drawn envelope will conform to the envelope shown in FIG. 5B, namely, the cam profile of cam surface 18*b* of swing cam 18.

FIG. 5A shows contact positions between swing cam 5 on the side of right bank B1 and roller 12 of swing arm 6 which acts as a cam follower, with the assumption that swing cam 5 as shown in FIG. 6C is fixed in a coordinate system. In FIG. 5A, there are shown arcuate loci R1-R4 and R5-R8 of roller 12 of swing arm 6 which follows swing cam 5 when the swing angle of swing cam 5 on the side of right bank B1 is varied under the minimum lift control as shown in FIGS. 6A-6D and under the maximum lift control as shown in FIGS. 7A-7D. The cam profile of cam surface 5*b* of swing cam 5 is determined by loci R1-R4 and R5-R8 of roller 12 of swing arm 6. As compared to the cam profile of cam surface 5*b* of swing cam 5 which is linearly curved, the cam profile of cam surface 18*b* of swing cam 18 is roundly curved. Specifically, cam surface 18*b* of swing cam 18 is outward bulged larger than cam surface 5*b* of swing cam 5 such that a distance between cam surface 18*b* and connection point B between swing cam 18 and link rod 22 is increased and lift portion 18*d* is spaced from the axis of swing cam 18 further beyond cam nose portion 18*c*. The difference in the cam profile between cam surface 5*b* of swing cam 5 and cam surface 18*b* of swing cam 18 is made in order to provide the same valve lift amount of intake valves 2, 2 on right and left banks B1 and B2 as explained above.

Next, referring to FIGS. 6A-6D and FIGS. 8A-8D, the rotation angles of drive cams 4, 4, the swing angles of swing cams 5, 18 and the valve lifts on the respective sides of right and left banks B1 and B2 which are varied through the valve actuating mechanisms and the variable operation mechanisms on respective banks B1 and B2 under the minimum lift control will be explained. The operating characteristics of control mechanisms 8, 8, i.e., control shafts 26 and control cams 27, of the variable operation mechanisms on the respective sides of right and left banks B1 and B2 are the same under the minimum lift control. Motion transmission mechanisms 7, 7, i.e., link members 20, 21 and 22, of the variable operation mechanisms on the respective sides of right and left banks B1 and B2 are operated by control mechanisms 8, 8, and therefore, motion transmission mechanisms 7, 7 have the same operating characteristic under the minimum lift control. Accordingly, swing cam 5 on the side of right bank B1 and swing cam 18 on the side of left bank B2 have the same swing motion characteristic under the minimum lift control.

As shown in FIG. 6A, drive cam 4 on the side of right bank B1 is located in the angular position in which the central axis of drive cam 4, central axis X of drive shaft 3 and a connecting point between rocker arm 20 and link arm 21 lie on the same line. In this angular position, drive cam 4 has rotation angle X1. Meanwhile, the rotation angle of drive cam 4 is expressed herein by a position of line extending through the central axis of drive cam 4 and central axis X of drive shaft 3. When drive cam 4 is located in the angular position with rotation angle X1, swing cam 5 is located in the most swing-up position where the swing angle is reference swing angle θ1. On the other hand, as shown in FIG. 8A, drive cam 4 on the side of left bank B2 is located in the same angular position as that shown in FIG. 6A, in which drive cam 4 has rotation angle X1. When drive cam 4 on the side of left bank B2 is located in the angular position, swing cam 18 is located in the same most swing-up position as that shown in FIG. 6A, in which the swing angle is reference swing angle θ1.

As shown in FIG. 6B, when drive cam 4 on the side of right bank B1 is rotated from the angular position shown in FIG. 6A in the clockwise direction and moved to the angular position with rotation angle X2, swing cam 5 on the side of right bank B1 is located in the swing angle position with swing angle θ2. On the other hand, as shown in FIG. 8B, when drive cam 4 on the side of left bank B2 is rotated from the angular position shown in FIG. 8A in the clockwise direction and moved to the angular position with rotation angle X2, swing cam 18 on the side of left bank B2 is located in the swing angle position with swing angle θ2. The rotational motion of respective drive cams 4 is transmitted to respective swing cams 5, 18 through motion transmission mechanisms 7, 7 which are arranged in the parallel relation to each other with respect to the bank centerline, whereby swing angle θ2 of swing cam 5 and swing angle θ2 of swing cam 18 becomes equal to each other.

Swing cams 5, 18 on the respective sides of right and left banks B1 and B2 have the cam profiles which are different from each other and configured to provide the same valve lift relative to the same swing angle on the sides of right and left banks B1 and B2 to compensate the difference in valve lift owing to the operating characteristic of the mirror-symmetrically arranged valve actuating mechanisms on the respective sides of right and left banks B1 and B2. As a result, same valve lift L1*i* as shown in FIGS. 6B and 8B is achieved on the sides of right and left banks B1 and B2.

When drive cams 4, 4 on the respective sides of right and left banks B1 and B2 are then rotated and moved to the angular positions in which drive cams 4, 4 have same rotation angle X3 as shown in FIGS. 6C and 8C, swing cams 5, 18 on the respective sides of right and left banks B1 and B2 are located in the swing angle positions in which swing cams 5, 18 have same swing angle θ3. Accordingly, as shown in FIGS. 6C and 8C, same peak lift L1*p* are provided on the respective sides of right and left banks B1 and B2.

When drive cams 4, 4 on the respective sides of right and left banks B1 and B2 are then rotated and moved to the angular positions in which drive cams 4, 4 have same rotation angle X4 as shown in FIGS. 6D and 8D, swing cams 5, 18 on the respective sides of right and left banks B1 and B2 are located in the swing angle positions in which swing cams 5, 18 have same swing angle θ4. In the swing angle positions, same valve lift L1*i* is provided on the respective sides of right and left banks B1 and B2 as shown in FIGS. 6D and 8D.

When drive cams 4, 4 on the respective sides of right and left banks B1 and B2 are then rotated and returned to the angular positions with rotation angle X1, swing cams 5, 18 on the respective sides of right and left banks B1 and B2 are returned to the swing angle positions with reference swing angle θ1. Thus, under the minimum lift control, one round of the rotational motion of drive cams 4, 4 and the swing motion of swing cams 5, 18 is ended.

Referring to FIGS. 7A-7D and FIGS. 9A-9D, the rotation angles of drive cams 4, 4, the swing angles of swing cams 5, 18 and the valve lifts on the respective sides of right and left banks B1 and B2 which are varied through the valve actuating mechanisms and the variable operation mechanisms on respective banks B1 and B2 under the maximum lift control will be explained. The maximum lift control operation is carried out by rotating control shafts 26 of control mechanisms 8, 8 of the variable operation mechanisms on the respective sides of right and left banks B1 and B2 by the same angle. That is, the operating characteristics of control mechanisms 8, 8 on the respective sides of right and left banks B1 and B2 are the same under the maximum lift control. Therefore, the operating characteristics of motion transmission mechanisms 7, 7 on the respective sides of right and left banks B1 and B2 are the same under the maximum lift control, notwithstanding the attitude of the respective link members 20, 21 and 22 of motion transmission mechanisms 7, 7 under the maximum lift control is different from that under the minimum lift control. Accordingly, swing cams 5, 18 on the respective sides of right and left banks B1 and B2 have the same swing motion characteristic under the maximum lift control, though it is different from the swing motion characteristic under the minimum lift control.

As shown in FIGS. 7A and 9A, drive cams 4, 4 on the respective sides of right and left banks B1 and B2 are located in the angular positions in which drive cams 4, 4 have same rotation angle X5. Meanwhile, the rotation angle of each of drive cams 4, 4 is expressed herein by a position of line extending through the central axis of drive cam 4 and central axis X of drive shaft 3. In the respective angular positions, the central axis of drive cam 4, central axis X of drive shaft 3 and a connecting point between rocker arm 20 and link arm 21 lie on the same line. When drive cams 4, 4 on the respective sides of right and left banks B1 and B2 are located in the angular positions with same rotation angle X5, swing cams 5, 18 on the respective sides of right and left banks B1 and B2 are located in the most swing-up positions in which swing cams 5, 18 have same swing angle θ5 which is larger than reference swing angle θ1.

When drive cams 4, 4 on the respective sides of right and left banks B1 and B2 are rotated from the angular positions shown in FIGS. 7A and 9A and moved to the angular positions in which drive cams 4, 4 have same rotation angle X6 as shown in FIGS. 7B and 9B, swing cams 5, 18 on the respective sides of right and left banks B1 and B2 are located in the swing angle positions in which swing cams 5, 18 have same swing angle θ6. Since swing cams 5, 18 on the respective sides of right and left banks B1 and B2 have the cam profiles which are different from each other and configured to provide the same valve lift relative to the same swing angle on the respective sides of right and left banks B1 and B2 as explained above, same valve lift L2*i* as shown in FIGS. 7B and 9B is provided on the respective sides of right and left banks B1 and B2.

When drive cams 4, 4 on the respective sides of right and left banks B1 and B2 are then rotated and moved to the angular positions in which drive cams 4, 4 have same rotation angle X7 as shown in FIGS. 7C and 9C, swing cams 5, 18 on the respective sides of right and left banks B1 and B2 are located in the swing angle positions in which swing cams 5, 18 have same swing angle θ7. Accordingly, as shown in FIGS. 7C and 9C, same peak lift L2*p* are provided on the respective sides of right and left banks B1 and B2.

When drive cams 4, 4 on the respective sides of right and left banks B1 and B2 are then rotated and moved to the angular positions in which drive cams 4, 4 have same rotation angle X8 as shown in FIGS. 7D and 9D, swing cams 5, 18 on the respective sides of right and left banks B1 and B2 are located in the swing angle positions in which swing cams 5, 18 have same swing angle θ8. In the swing angle positions, same valve lift L2*i* is provided on the respective sides of right and left banks B1 and B2 as shown in FIGS. 7D and 9D.

When drive cams 4, 4 on the respective sides of right and left banks B1 and B2 are then rotated and returned to the angular positions with rotation angle X5, swing cams 5, 18 on the respective sides of right and left banks B1 and B2 are returned to the swing angle positions with swing angle θ5. Thus, under the maximum lift control, one round of the rotational motion of drive cams 4, 4 and the swing motion of swing cams 5, 18 is ended.

Accordingly, in both of the minimum lift control operation and the maximum lift control operation, the valve lift curve of intake valves 2, 2 on the side of right bank B1 and the valve lift curve on the side of left bank B2 become identical to each other. This is because the operating characteristics of the variable operation mechanisms 8, 8, namely, the operation angle η of control shafts 26, 26 and the eccentric amount "e" of control cams 27, 27, on the respective sides of right and left banks B1 and B2 are the same, and the operating characteristics of motion transmission mechanisms 7, 7 on the respective sides of right and left banks B1 and B2 are the same.

As is understood from the above-explanation, in the valve operating apparatus of this embodiment, the valve lift curve of intake valves 2, 2 of one of the two groups of cylinders within left bank B2 can be identical to the valve lift curve of intake valves 2, 2 of the other of the two groups of cylinders within right bank B1. As a result, the same combustion characteristic can be provided for the respective groups of cylinders to thereby ensure stability of the engine operation.

Further, even when the valve actuating member on the side of right bank B1 and the valve actuating member on the side of left bank B2 have the constructions different from each other, the valve lift curve of intake valves 2, 2 for the one of the two groups of cylinders within left bank B2 can be identical to the valve lift curve of intake valves 2, 2 for the other of the two groups of cylinders within right bank B1.

Further, since intake valves 2, 2, swing arms 6, 6 and drive shafts 3, 3 are mirror-symmetrically arranged on the respective sides of right and left banks B1 and B2 similarly to the conventional valve operating apparatus, these parts can be used without modifying the structure.

Further, in this embodiment in which the valve operating apparatus of this embodiment is applied to the V-type internal combustion engine, cylinder heads 1, 1 of right and left banks B1 and B2 may be constructed in a mirror-symmetrical relation to each other with respect to the bank centerline. In such a case, intake valves 2, 2, swing arms 6, 6 and drive shafts 3, 3 also may be mirror-symmetrically arranged with respect to the bank centerline, so that installability of the valve operating apparatus can be enhanced.

Figure 14:
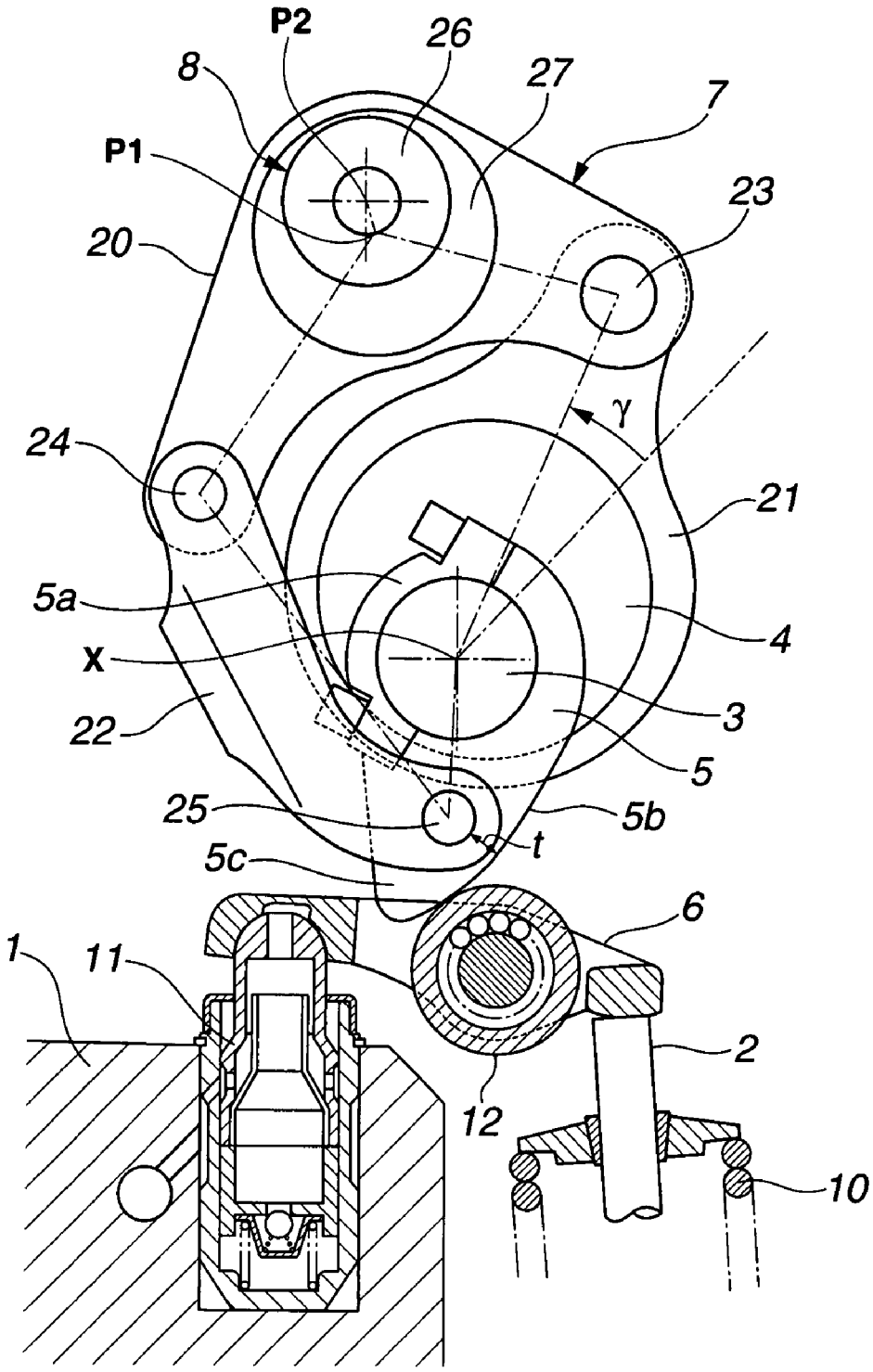
FIG. 14 is a cross section of an essential part of a second embodiment of the valve operating apparatus according to the present invention.

Referring to FIG. 14, a second embodiment of the valve operating apparatus according to the present invention will be explained hereinafter. The second embodiment differs from the first embodiment in that the valve actuating mechanism and the swing cam on the side of left bank B2 are the same as those on the side of right bank B1. The second embodiment further differs from the first embodiment in that a mounting angle position of motion transmission mechanism 7 on the side of left bank B2 with respect to the corresponding swing cam is angularly offset from the mounting angle position of motion transmission mechanism 7 on the side of right bank B1 with respect to the corresponding swing cam. Alternatively, a mounting angle position of the swing cam on the side of left bank B2 with respect to the corresponding motion transmission mechanism 7 may be angularly offset from the mounting angle position of the swing cam on the side of right bank B1 with respect to the corresponding motion transmission mechanism 7.

As shown in FIG. 14, the valve actuating mechanism including swing arm 6 and pivot 11 on the side of left bank B2 are the same as that on the side of right bank B1. The swing cam as indicated at 5 on the side of left bank B2 has the same cam profile as that of swing cam 5 on the side of right bank B1. Motion transmission mechanism 7 on the side of left bank B2 is mounted to swing cam 5 on the side of left bank B2 in a predetermined mounting angle position. As shown in FIG. 14, the mounting angle position of motion transmission mechanism 7 on the side of left bank B2 is angularly offset about the axis of swing cam 5, i.e., central axis X of drive shaft 3, by the predetermined angle γ in the counterclockwise direction from a mounting angle position of motion transmission mechanism 7 on the side of right bank B1 with respect to the corresponding swing cam 5. Namely, in the mounting angle position, motion transmission mechanism 7 on the side of left bank B2 is angularly offset in such a direction as to be away from the bank centerline on the side of left bank B2. With the angularly offset mounting of motion transmission mechanism 7 on the side of left bank B2, control mechanism 8 on the side of left bank B2 is arranged in the angularly offset relation to control mechanism 8 on the side of right bank B1.

In the second embodiment, since the angular phase of drive shaft 3 in the valve lift curve is offset by the predetermined angle γ, it is necessary to compensate the offset of the angular phase of drive shaft 3 by a suitable manner. For instance, the offset can be compensated by varying a phase of mounting the driven sprocket to drive shaft 3 or a position of mounting drive cam 4 to drive shaft 3, or otherwise, by modifying a control map of a cam phaser. In such a case, in addition to the same valve lift curve, the same valve lift characteristic including a lift phase can be provided on the respective sides of right and left banks B1 and B2.

The second embodiment can perform the same effects as those of the first embodiment. Namely, swing cams 5, 5 on the side of left bank B2 has the same swing motion characteristic as that of swing cams 5, 5 on the side of right bank B1, so that the valve lift curve of intake valves 2, 2 of the one of the two groups of cylinders within left bank B2 can be identical to the valve lift curve of intake valves 2, 2 of the other of the two groups of cylinders within right bank B1.

Further, in the second embodiment, a thickness "t" of swing cam 5 on the side of left bank B2 which extends between cam surface 5*b* and the pin insertion hole for connection pin 25 can be reduced to substantially the same thickness as that of swing cam 5 on the side of right bank B1, unlike swing cam 18 of the first embodiment. In such a case, a weight of swing cam 5 on the side of left bank B2 can be substantially equal to a weight of swing cam 5 on the side of right bank B1. This serves for reducing the weight of the valve operating apparatus. Further, in the case of reducing the thickness "t" of swing cam 5 on the side of left bank B2, a moment of inertia of swing cam 5 on the side of left bank B2 about the axis of swing cam 5 can be substantially equal to a moment of inertia of swing cam 5 on the side of right bank B1. This serves for preventing a difference in valve lift curves of intake valves 2, 2 between the one of the two groups of cylinders within left bank B2 and the other of the two groups of cylinders within right bank B1 which will be caused due to a difference in inertia load in the high-speed range of the engine. Alternatively, the spring forces of valve springs 10, 10 on the sides of right and left banks B1 and B2 can be set to be different from each other depending on the moments of inertia of swing cams 5, 5 on the sides of right and left banks B1 and B2. In such a case, the difference in valve lift curves of intake valves 2, 2 between the one of the two groups of cylinders within left bank B2 and the other of the two groups of cylinders within right bank B1 can be reduced.

Further, in the second embodiment, motion transmission mechanism 7 and control mechanism 8 on the side of left bank B2 are angularly offset in such a direction as to be spaced away from the intake system. Accordingly, this arrangement of motion transmission mechanism 7 and control mechanism 8 is advantageous in view of layout of the intake system over cylinder head 1.

Figure 15B:
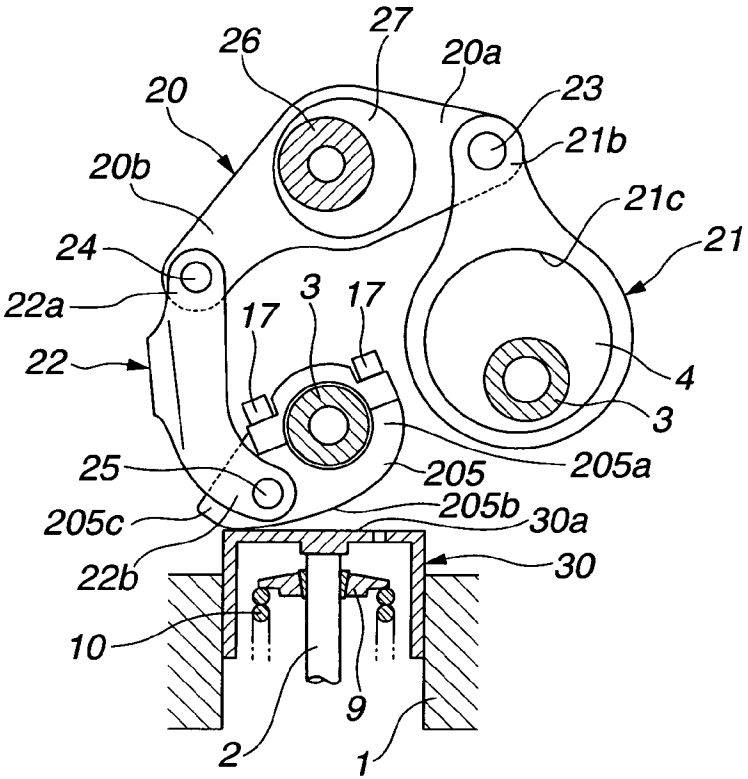
FIGS. 15A and 15B are cross sections of a third embodiment of the valve operating apparatus according to the present invention, which is applied to an in-line 6-cylinder internal combustion engine.
Figure 15A:
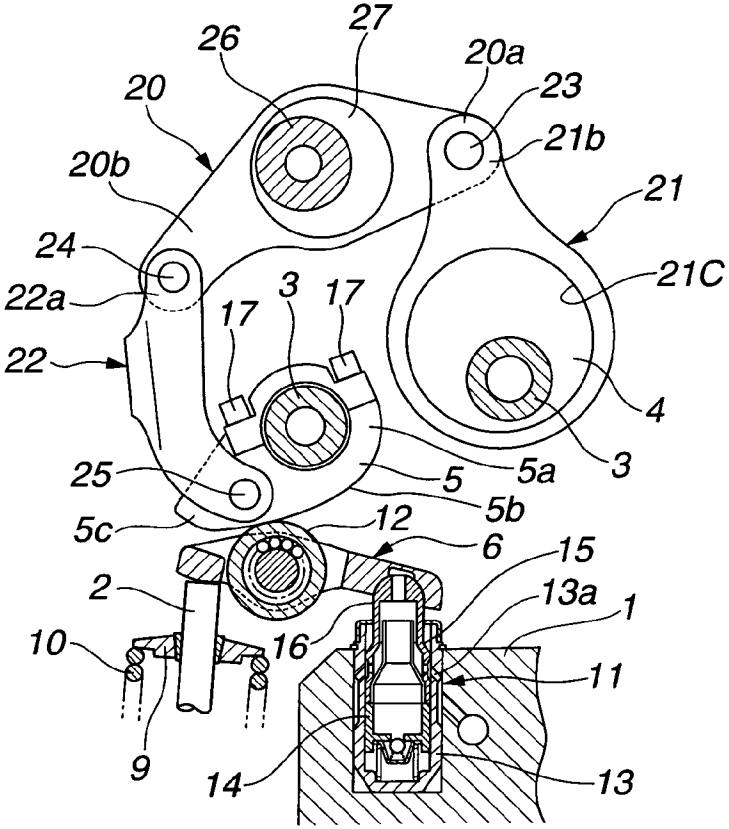

Referring to FIGS. 15A and 15B, there is shown a third embodiment of the valve operating apparatus according to the present invention. In this embodiment, the valve operating apparatus is applied to an in-line 6-cylinder internal combustion engine. Swing arm 6 as shown in FIG. 15A is used as the valve actuating member for one of the two groups of cylinders each group having three cylinders. Direct-operated valve lifter 30 as shown in FIG. 15B, which has one closed-ended cylindrical shape, is used as the valve actuating member for the other of the two groups of cylinders. Valve lifter 30 includes top surface 30*a* as the cam follower which follows swing cam 205. Swing cam 205 includes cam surface 205*b* which is contacted with top surface 30*a* of valve lifter 30. A cam profile of cam surface 205*b* of swing cam 205 has an increased radius of curvature corresponding to top surface 30*a* of valve lifter 30 as compared to the cam profile of cam surface 5*b* of swing cam 5 which is contacted with roller 12 of swing arm 6 as shown in FIG. 15A. The cam profile of cam surface 205*b* of swing cam 205 is configured to provide the same valve lift curve as a valve lift curve which is provided on the side of swing cam 5. The cam profile of cam surface 205*b* of swing cam 205 can be set as an envelope which is drawn by loci of top surface 30*a* of valve lifter 30 in the same method as described above by referring to FIG. 5B.

As described in the third embodiment, even when the valve actuating member for one of the two groups of cylinders and the valve actuating member for the other of the two groups of cylinders have the constructions different from each other, the valve lift curve of intake valves for the one of the two groups of cylinders can be identical to the valve lift curve of intake valves for the other of the two groups of cylinders.

Further, the third embodiment can perform an effect that positions of intake valves 2, 2 are varied each group of cylinders. Therefore, freedom of the layout of intake valves 2, 2 for each group of cylinders can be increased. Otherwise, gas motion property of intake gas flowing into the cylinder can be changed, while keeping the same intake gas quantity for each group of cylinders. This serves for enhancing the engine performance.

Further, even when it is required to modify the construction and arrangement of the valve actuating mechanisms for one of the two groups of cylinders due to limitation in layout on an upper side of the engine, a valve lift curve of engine valves for the one of the two groups of cylinders can be identical to a valve lift curve of engine valves for the other of the two groups of cylinders.

The construction of drive cam 4 is not limited to the above-explained embodiments, and may be replaced, for example, with that of an oval-shaped cam as described in U.S. Pat. No. 5,996,540.

This application is based on a prior Japanese Patent Application No. 2006-025252 filed on Feb. 2, 2006. The entire contents of the Japanese Patent Application No. 2006-025252 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve operating apparatus for an internal combustion engine that includes a first group of cylinders and a second group of cylinders and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam;

the drive cam, the swing cam, the motion transmission mechanism and the valve actuating member being disposed for each of the cylinders in the first and second groups, wherein the swing cam is one of a first swing cam for the first group of cylinders and a second swing cam for the second group of cylinders, the motion transmission mechanism is one of a first motion transmission mechanism for the first group of cylinders and a second motion transmission mechanism for the second group of cylinders, and the valve actuating member is one of a first valve actuating member for the first group of cylinders and a second valve actuating member for the second group of cylinders, wherein the first and second swing cams are provided with identical swing motion characteristic with respect to a rotation angle of the drive cam through the first and second motion transmission mechanisms, wherein the first swing cam and the first valve actuating member cooperate with each other to provide a valve lift amount of the engine valve for the first group of cylinders with respect to a swing angle of the first swing cam, which is identical to a valve lift amount of the engine valve for the second group of cylinders with respect to a swing angle of the second swing cam, and wherein the first swing cam and the second swing cam have cam profiles different from each other.

2. The valve operating apparatus as claimed in claim 1, comprising control mechanisms which respectively control attitudes of the first and second motion transmission mechanisms so as to provide an identical operating characteristic of the first and second motion transmission mechanisms.

3. The valve operating apparatus as claimed in claim 1, wherein the valve operating apparatus is applicable to a V-type internal combustion engine including two banks which are mirror-symmetrically arranged with respect to a bank centerline.

4. The valve operating apparatus as claimed in claim 3, wherein the valve actuating members are arranged on the two banks in a mirror-symmetric relation to each other with respect to the bank centerline.

5. The valve operating apparatus as claimed in claim 3, wherein the valve actuating member is provided on each of the two banks, and the valve actuating members provided on the two banks are different in construction.

6. The valve operating apparatus as claimed in claim 1, wherein the valve operating apparatus is applicable to an in-line internal combustion engine.

7. The valve operating apparatus as claimed in claim 1, wherein the first motion transmission mechanism is mounted to the first swing cam in a mounting angle position which is angularly offset about the axis of the first swing cam from a mounting angle position of the second motion transmission mechanism with respect to the second swing cam.

8. The valve operating apparatus as claimed in claim 1, wherein the first swing cam is mounted to the first motion transmission mechanism in a mounting angle position which is angularly offset about the axis of the first swing cam from a mounting angle position of the second swing cam with respect to the second motion transmission mechanism.

9. The valve operating apparatus as claimed in claim 1, wherein a moment of inertia of the first swing cam about the axis of the first swing cam is substantially identical to a moment of inertia of the second swing cam about the axis of the second swing cam.

10. The valve operating apparatus as claimed in claim 1, wherein the first and second valve actuating members each comprise a valve spring which biases the engine valve toward a closed position, the valve spring comprising a valve spring for the first group cylinders and a valve spring for the second group of cylinders, the valve spring for the first group of cylinders having a spring force which is set to be different from a spring force of the valve spring for the second group of cylinders depending on moment of inertia of the first swing cam and moment of inertia of the second swing cam.

11. The valve operating apparatus as claimed in claim 1, wherein the valve actuating member comprises a cylindrical valve lifter for the first group of cylinders and a swing arm for the second group of cylinders.

12. A valve operating apparatus for a V-type internal combustion engine that includes a first group of cylinders and a second group of cylinders which are arranged in a generally V-shape and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam, the valve actuating member including a cam follower which follows the swing cam;

the drive cam, the swing cam, the motion transmission mechanism and the valve actuating member being disposed for each of the cylinders in the first and second groups, wherein the swing cam includes a first swing cam for the first group of cylinders and a second swing cam for the second group of cylinders, and the motion transmission mechanism includes a first motion transmission mechanism for the first group of cylinders and a second motion transmission mechanism for the second group of cylinders, wherein the first and second swing cams are provided with identical swing motion characteristic through the first and second motion transmission mechanisms, and wherein the first swing cam has a cam profile configured to provide a valve lift curve of the engine valve for the first group of cylinders which is identical to a valve lift curve of the engine valve for the second group of cylinders, the cam profile of the first swing cam being set as an envelope which is drawn by arcuate loci of the cam follower following the first swing cam when the engine valve for the first group of cylinders is operated to be open and closed, the envelope being determined on the basis of a distance between a center of curvature of each of the loci of the cam follower and the axis of the first swing cam, and an angle which is formed between a line extending through the center of curvature of each of the loci of the cam follower and the axis of the first swing cam and a line extending through the axis of the first swing cam and a connection point between the first swing cam and the first motion transmission mechanism.

13. A valve operating apparatus for an internal combustion engine that includes a first group of cylinders and a second group of cylinders and at least one engine valve for each of the cylinders in the first and second groups, the valve operating apparatus comprising:

a drive cam fixed to a shaft which is rotated in synchronization with a crankshaft of the engine;

a swing cam disposed so as to be swingable about an axis;

a motion transmission mechanism operative to convert torque of the drive cam to a swing motion of the swing cam; and a valve actuating member which operates the engine valve to be open and closed in association with the swing motion of the swing cam, the valve actuating member including a cam follower which follows the swing cam;

the drive cam, the swing cam, the motion transmission mechanism and the valve actuating member being disposed for each of the cylinders in the first and second groups, wherein the swing cam includes a first swing cam for the first group of cylinders and a second swing cam for the second group of cylinders, and the motion transmission mechanism includes a first motion transmission mechanism for the first group of cylinders and a second motion transmission mechanism for the second group of cylinders, wherein the first and second motion transmission mechanisms are constructed to provide the first and second swing cams with identical swing motion characteristic, and wherein the first swing cam has a cam profile which is different from a cam profile of the second swing cam, the cam profile of the first swing cam being set as an envelope which is drawn by arcuate loci of the cam follower of the valve actuating member which follows the first swing cam when the first swing cam is operated so as to provide a valve lift curve of the engine valve for the first group of cylinders which is identical to a valve lift curve of the engine valve for the second group of cylinders.

* * * * *